United States Patent [19]

Johnson et al.

[11] 4,422,393

[45] Dec. 27, 1983

[54] SEWING MACHINE HAVING AUTOMATIC PALLET HANDLING

[75] Inventors: Herbert Johnson; Richard M. Elliott, both of Beverly; Donald F. Herdeg, So. Hamilton; Alan M. Peck, Beverly, all of Mass.

[73] Assignee: USM Corporation, Farmington, Conn.

[21] Appl. No.: 266,144

[22] Filed: May 22, 1981

[51] Int. Cl.[3] ..... D05C 9/04

[52] U.S. Cl. ..... 112/121.15

[58] Field of Search ..... 112/121.15, 121.12, 112/121.11, 121.29, 103, 102, 104, 2

[56] References Cited

U.S. PATENT DOCUMENTS

| | | | |
|---|---|---|---|
| 3,769,924 | 11/1973 | Rogers et al. | 112/121.12 X |
| 3,762,348 | 10/1973 | Junemann | 112/121.12 |
| 3,895,590 | 7/1975 | Perlino | 112/121.12 |
| 4,305,338 | 12/1981 | Adamson | 112/121.12 X |
| 4,336,761 | 6/1982 | Magnan | 112/121.12 |

*Primary Examiner*—Peter P. Nerbun

*Attorney, Agent, or Firm*—William F. White

[57] ABSTRACT

A system for processing workpieces prearranged within pallets that are to be sewn by a sewing machine. The system includes apparatus for automatically processing a pallet from an input location to a location wherein the pallet can be automatically attached to a positioning system. The positioning system moves the attached pallet into position underneath the sewing machine head for subsequent sewing of a stitch pattern. The sewn workpiece is returned to a location where the pallet can be detached from the positioning system. An ejector mechanism automatically moves the detached pallet to a location which does not interfere with the automatic processing of another pallet loaded at the input location.

87 Claims, 13 Drawing Figures

SEWING MACHINE HAVING AUTOMATIC PALLET HANDLING

FIELD OF THE INVENTION

This invention relates to the handling of workpieces within an automatic sewing machine system. In particular, this invention relates to the manipulation of pallets containing workpieces within an automatic sewing machine system.

BACKGROUND OF THE INVENTION

Automatic sewing machines which sew workpieces previously arranged within pallets have heretofore been known. Examples of such sewing machine systems are illustrated in U.S. Pat. No. 3,814,038 and U.S. Pat. No. 3,877,405. These automatic sewing machines automatically sew a workpiece that has been previously arranged within a pallet. The pallet must however first be manually loaded into the sewing machine and thereafter connected to the automatic positioning system. The pallet must also be manually removed from the automatic positioning system following completion of the automatic sewing.

It is to be appreciated that the time devoted to loading and unloading of pallets can materially affect the overall productivity of these automatic sewing machines. In this regard, the attendant must usually spend considerable time handling the pallets and making sure that they are accurately locked into the machine so as to obtain the stitching accuracy normally desired. This usually requires a considerable number of sequential steps which consume valuable time when the machine is not actually in operation. These steps include unlocking a finished pallet, grasping it while it is still fully within the machine and moving it to a place to the side. At this time, the work is either physically removed and additional work inserted in the thus removed pallet or in the alternative another pallet of previously arranged work is loaded into place and carefully locked into the sewing machine system. It is to be appreciated that the aforementioned steps all contribute to the net down time of the machine between physical sewing operations.

It is also to be appreciated that the aforementioned loading and unloading steps may not be timely made by the attendant in the event that another automatic sewing machine is also in need of attention. Specifically, a machine may need attention because of thread breakage or bobbin changing. If the attendant must attend to such needs of another machine, then a pallet loading or unloading sequence may not be timely made.

OBJECTS OF THE INVENTION

It is an object of this invention to provide an automatic sewing machine with an automatic pallet handling capability.

It is another object of this invention to provide an automatic sewing system wherein there is minimal time devoted to the loading and unloading of workpieces that are to be sewn.

It is a still further object of this invention to provide an automatic sewing machine system wherein the pallet loading and unloading is accomplished in such a manner as to minimize damage to the pallets.

SUMMARY OF THE INVENTION

The above and other objects of the invention are accomplished by providing an automatic sewing machine system with a pallet handling system capable of processing pallets through three closely located positions near the sewing machine. The positions are close to one another so as to minimize the time and impact forces during transfer of the pallets. The top position serves as the input to the automatic sewing machine system wherein the operator or attendant manually places the pallet into position. The thus loaded pallet is lowered by various pallet handling structure under automatic control. The pallet is thereafter locked onto a carriage which moves the workpiece under the sewing head in accordance with a pre-programmed pattern. When the pattern has been successfully executed, the pallet is rapidly moved back to a docking position within the pallet handling system. The pallet is thereafter released from the carriage so as to move downward onto an ejector mechanism. The ejector mechanism subsequently moves the pallet outwardly for removal by the attendant. The pallet handling system will automatically sequence the next pallet if it has been timely loaded into the top position.

BRIEF DESCRIPTION OF THE DRAWINGS

The above and other features of the invention will now be particularly described with reference to the accompanying drawings, in which.

DESCRIPTION OF THE PREFERRED EMBODIMENT

Figure 1:
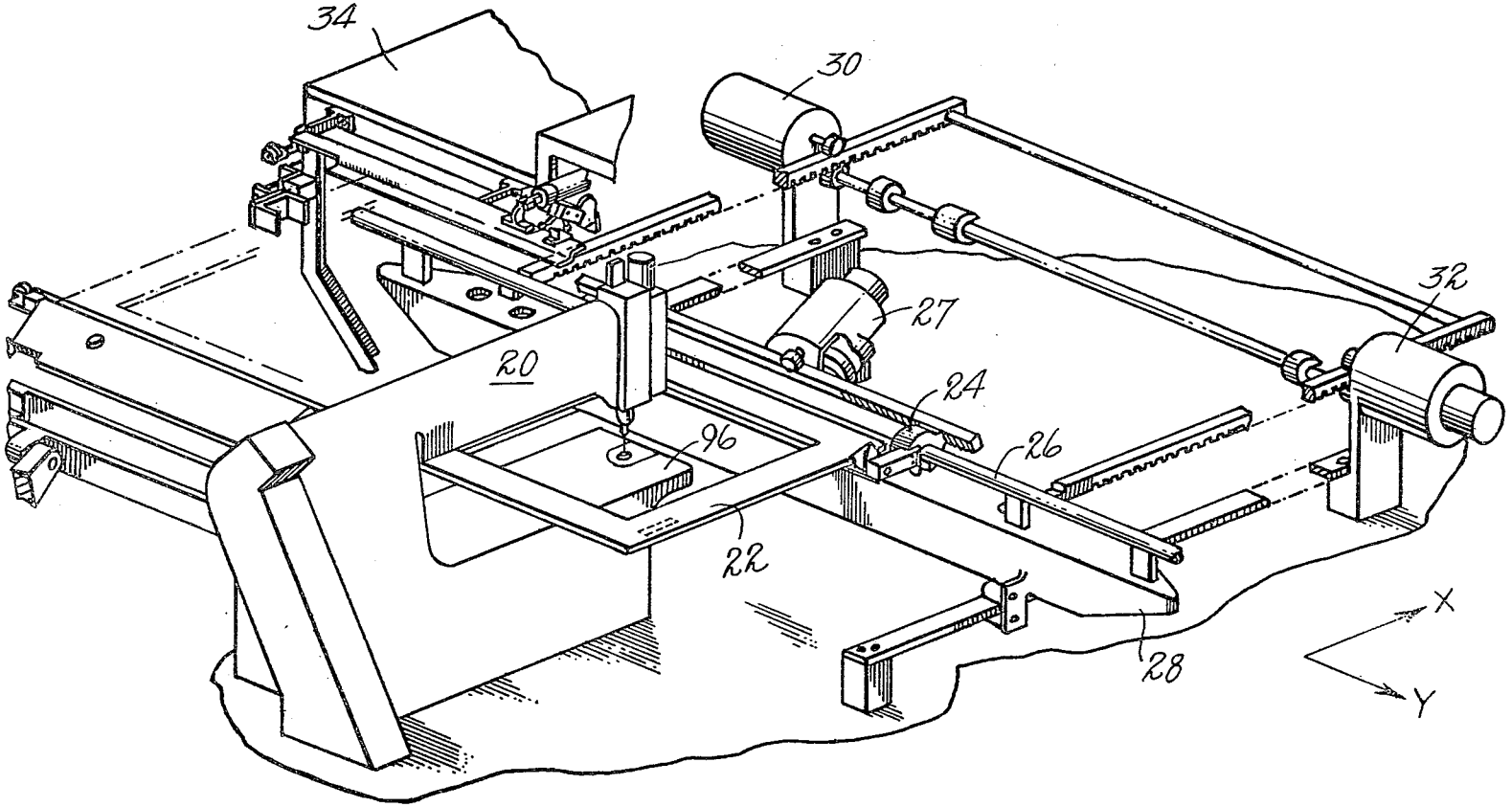
FIG. 1 is an overall perspective view of an automatic sewing machine system having an automatic pallet handling apparatus in association with an automatic positioning system.

Referring to FIG. 1, an automatic sewing machine system having X, Y positioning with respect to a sewing machine head 20 is generally shown. A pallet 22 is mounted to a carriage 24 which is driven in a Y direction along a cylindrical axis 26 by a motor 27. The cylindrical axis 26 is mounted on a frame 28 which is moved in an X direction by a pair of motors 30 and 32. The movement of the carriage 24 and the frame 28 is further disclosed in U.S. patent application Ser. No. 266,143 filed May 22, 1981 now patent No. 4,406,234, entitled, "Positioning Apparatus" filed in the names of Richard M. Elliott and Herbert Johnson on even date herewith. It is to be appreciated that the aforementioned X-Y positioning apparatus has been disclosed as only the preferred embodiment of a positioning system for use in the present invention. Other various combinational drive systems may also be used with the pallet handling apparatus of the present invention.

The pallet 22 is moved into position relative to the carriage 24 by a pallet handling system 34. As will be explained in detail hereinafter, the pallet handling system 34 is operative to simultaneously handle at least three pallets. These pallets will occupy respectively an input position, a middle position, and an output position. The pallet 22 is illustrated in FIG. 1 as being in the middle position which allows for automatic sewing.

Figure 2:
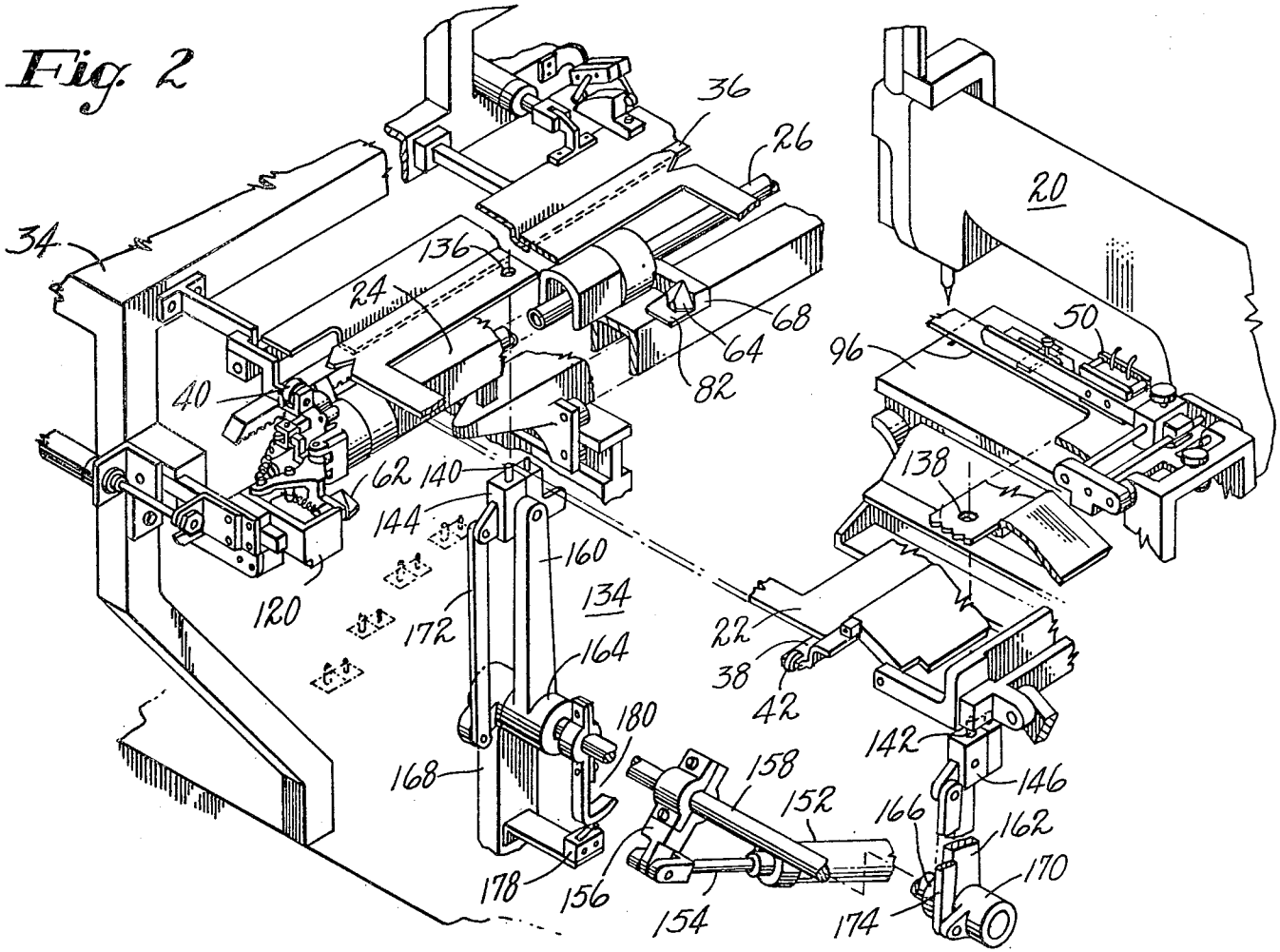
FIG. 2 is a perspective view of the pallet handling apparatus in association with the sewing machine head of the automatic sewing system.

Referring now to FIG. 2, the pallet 22 is illustrated in the input position within the pallet handling apparatus 34. In particular, the pallet 22 is seen to rest on a left shelf 36 and a right shelf 38 of the pallet handling system 34. The pallet has been previously loaded onto the left and right shelves via a pair of rollers 40 and 42.

Figure 3:
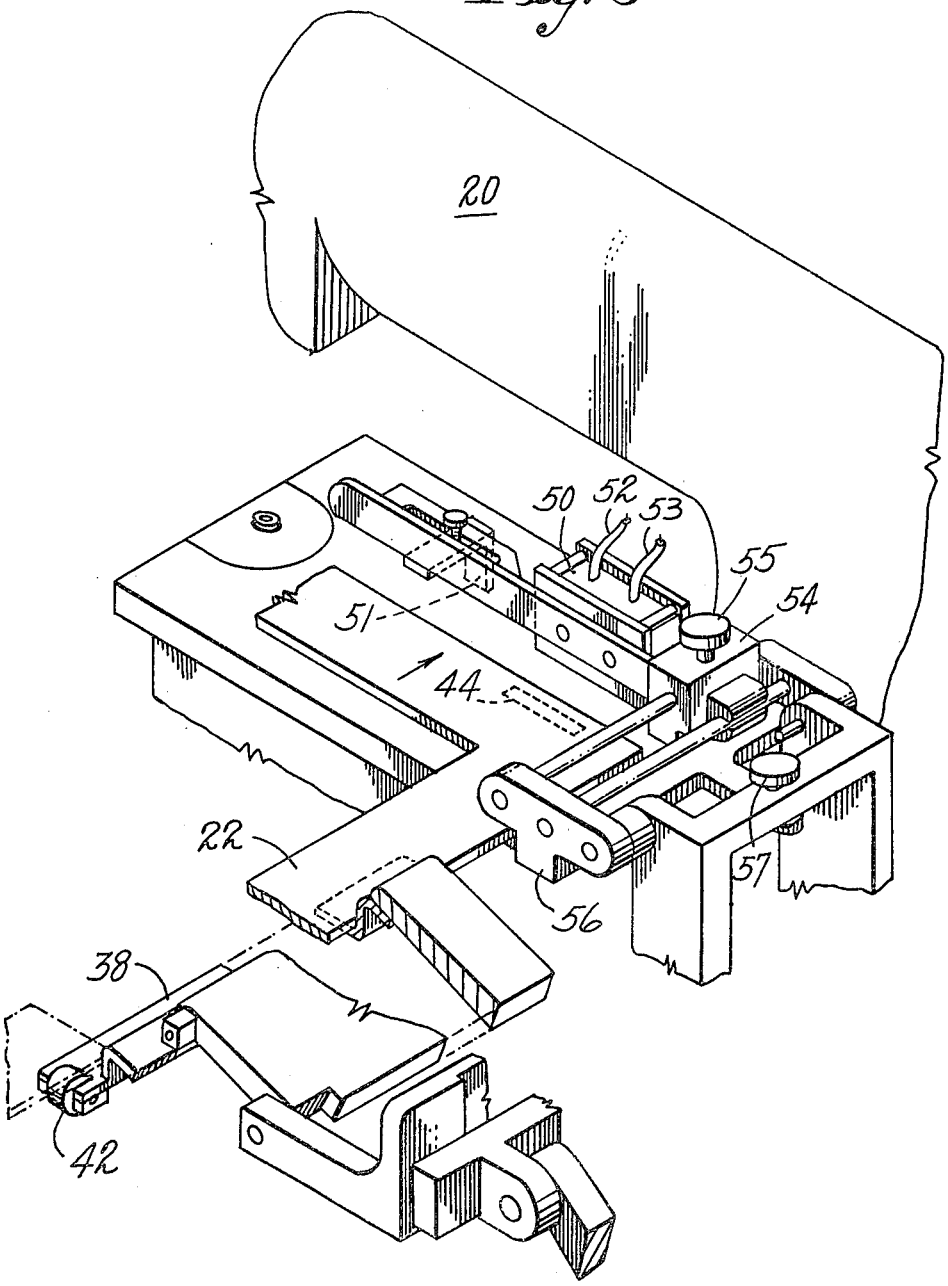
FIG. 3 illustrates the pallet sensor associated with the automatic pallet handling apparatus.

Referring to FIG. 3, a corner of the pallet 22 is shown in the process of being loaded onto the right shelf 38. It is to be noted that the pallet 22 is still being rolled into place over the roller 42. The corner of the pallet 22 is seen to have a pallet identification code 44 impressed thereon.

The pallet identification code 44 comprises a reflective surface which is sensed by a pallet identification sensor device 50 when the pallet 22 is moved back against a limit stop 51. In accordance with the invention, the pallet identification sensor device 50 comprises a pair of optical sensors which individually sense the pallet identification code 44. These optical sensors are operative to produce logically high signal conditions on lines 52 and 53 when the pallet identification code 44 is registered underneath the pallet identification sensor device 50. The lines 52 and 53 are otherwise logically low when no pallet has been thus registered.

Figure 10:
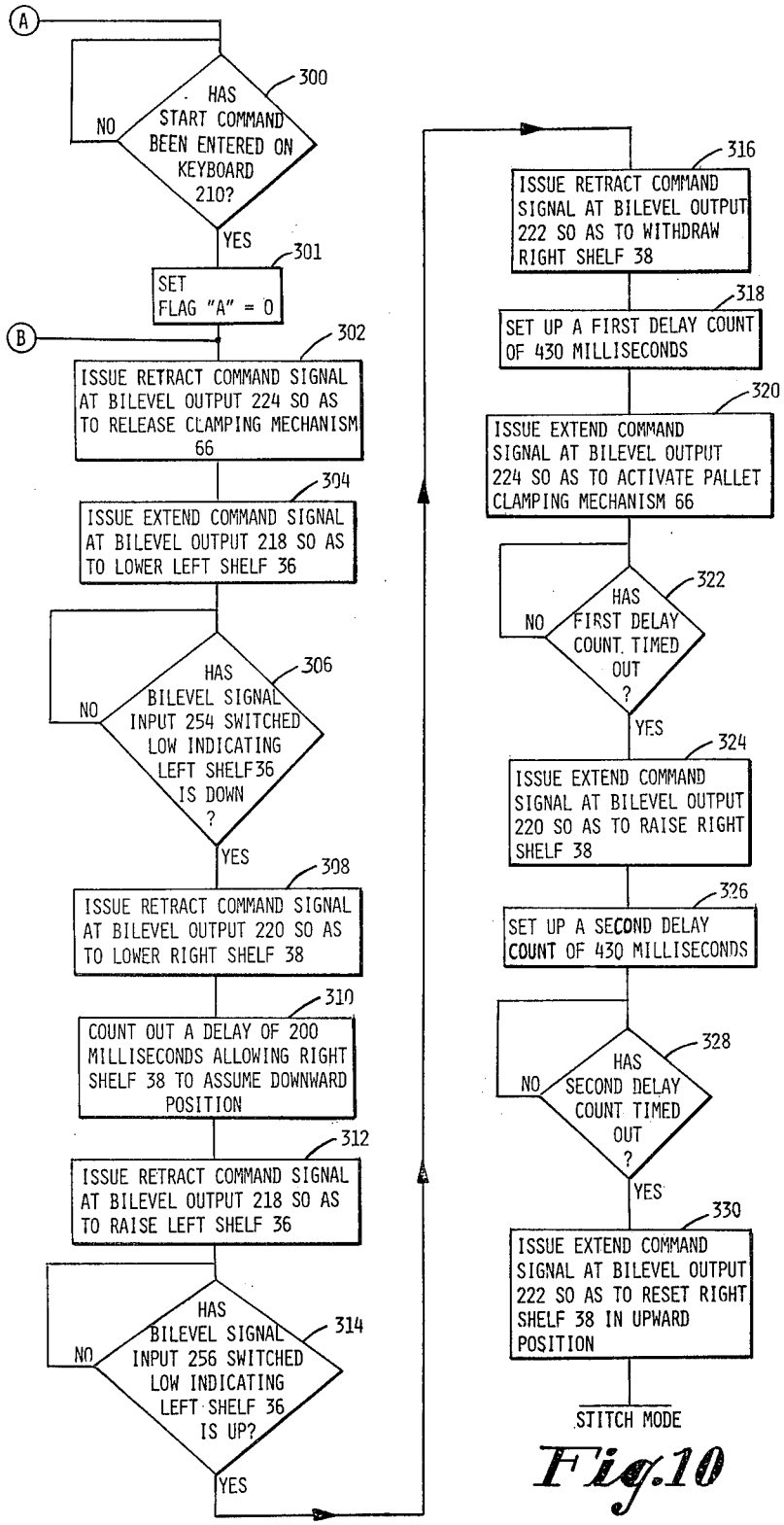
FIG. 10 illustrates the flow of computer commands within the automatic control system of FIG. 9 so as to facilitate the automatic loading of a pallet.

The lines 52 and 53 are connected to an automatic control system which is illustrated in FIG. 10. The details of this control system will be discussed hereinafter in conjunction with FIG. 10. For the present, it is merely to be noted that the control system senses the presence of the pallet in response to the signal conditions on the lines 52 and 53. The control system thereafter sequentially operates the elements comprising the pallet handling system 34 so as to move the sensed pallet through various defined pallet positions. This sequential operation of the elements is premised on the conditions of various switches present within the pallet handling system. These switches interface with the automatic control in much the same manner as the sensor 50. The mechanical operation of the pallet handling system will now be discussed before turning to the detailed description of the automatic control in FIG. 10.

The pallet identification sensor device 50 and the limit stop 51 are adjustably positioned within the pallet handling system 34 by a slidable mount 54 which can be fixed in any position via a set screw 55. In this manner, the position of the pallet identification sensor device 50 can be adjusted so as to accommodate different sized pallets. The mounting structure for the pallet identification sensor device 50 furthermore includes a pivotal mount 56 which allows the pallet identification sensor to be pivoted out of the way during sewing head maintenance.

Figure 4:
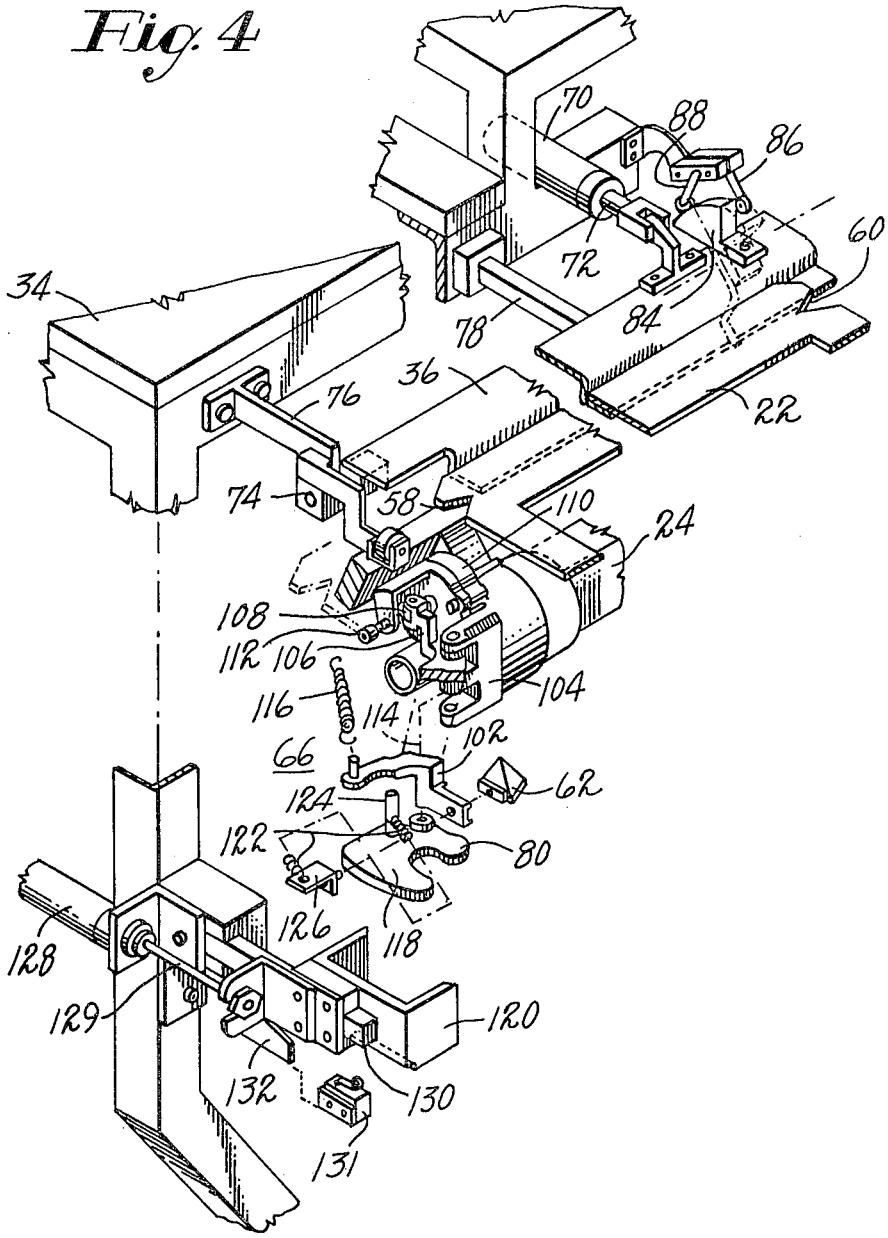
FIG. 4 is a perspective view of a portion of the automatic pallet handling apparatus.
Figure 6:
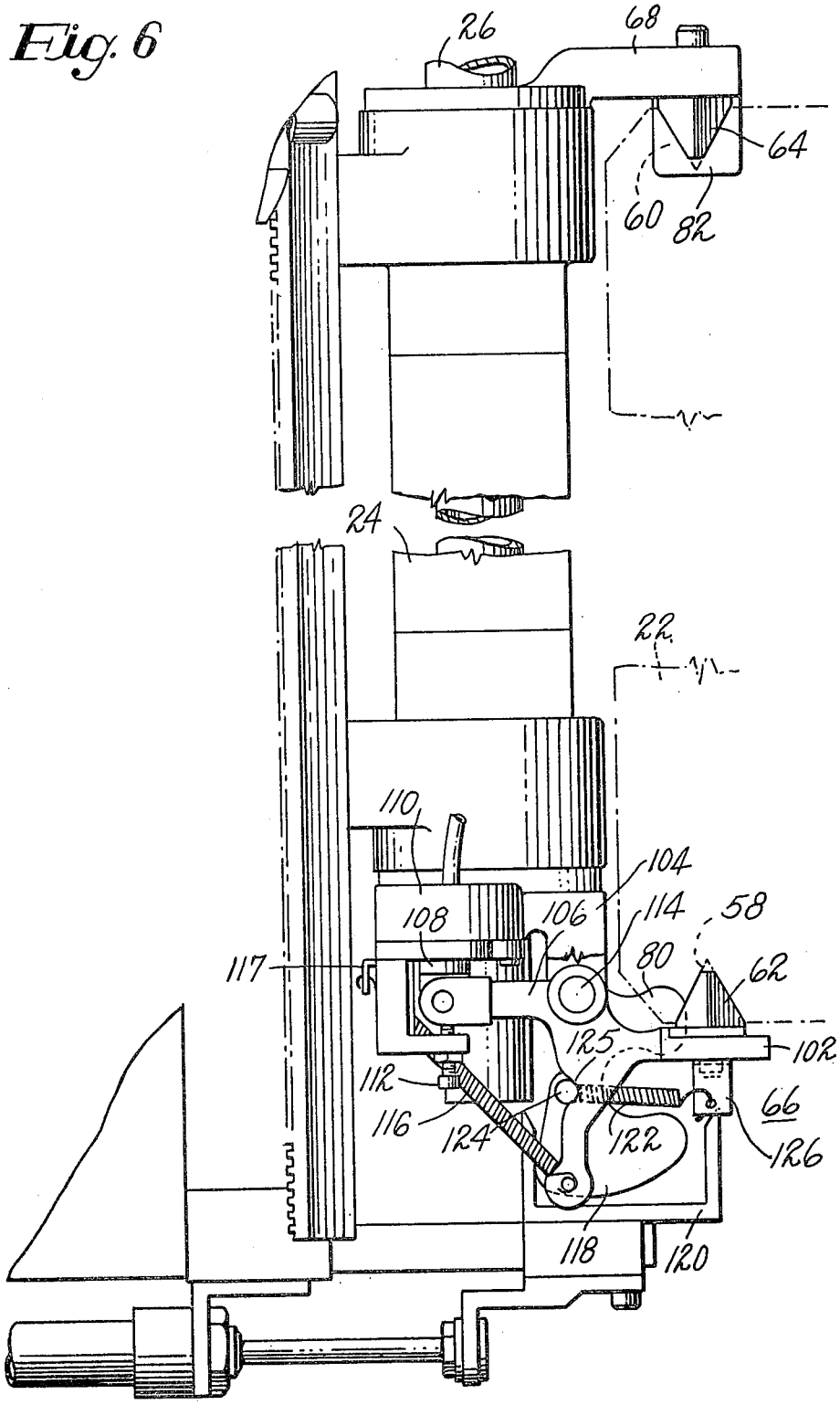
FIG. 6 illustrates the locking of the transferred pallet to a carriage within the automatic positioning system.

Having now described the loading and sensing of the pallet 22 at the top input position, it is now appropriate to turn to the various functioning mechanisms which permit the pallet 22 to assume the middle position within the pallet handling system. Referring to FIG. 4, the left portion of the pallet handling system 34 is illustrated in detail. The left portion of the pallet 22 is illustrated in place on the left shelf 36. This position of the pallet 22 is directly above the carriage 24 to which it is to be ultimately attached. In this regard, the pallet 22 is seen to have two V-notched grooves 58 and 60 located along opposing sides near each corner of the pallet. The V-notches 58 and 60 will ultimately be engaged by a pair of wedges 62 and 64 appearing at either end of the carriage 24 as is shown in FIG. 6. The wedge 62 will be driven into engagement with the V-notch 58 by a pallet clamping mechanism 66 which is attached to the one end of the carriage 24. The wedge 64 is affixed to the other end of the carriage 24 by an arm 68. The wedge 64 acts as a fixed registration for the V-notch 60 during the clamping action of the pallet clamping mechanism 66. The various elements comprising the pallet clamping mechanism 66 will be fully discussed hereinafter.

The manner in which the left edge of the pallet 22 drops downward to the carriage 24 will now be described. As has been previously noted, the left edge of the pallet with the V-notches 58 and 60 to either side rests on the left shelf 36 as shown in FIG. 4. An air cylinder 70 having an output shaft 72 is pivotally attached to the left shelf 36. Upon actuation of the air cylinder 70, the output shaft 72 extends outwardly so as to thereby rotate the left shelf 36 downwardly. The left shelf 36 rotates about a pivotal attachment 74 associated with a frame member 76 and a pivotal attachment (not shown) associated with a frame member 78. When the left shelf 36 has thus been rotated downwardly, the left edge of the pallet 22 drops past it onto a pallet support 80 associated with the wedge 62 and a pallet support 82 associated with the wedge 64. The pallet support 82 is not shown in FIG. 4 but can be seen in FIG. 2. The pallet support 82 is seen to be a tab located underneath the wedge 64. The tab has a sufficient support area projecting outwardly around the perimeter of the wedge 64. This outward tab portion supports a pallet in the vicinity of the V-notch 60 as is illustrated in FIG. 6. The pallet support 80 is also seen to have a tab portion supporting the pallet in the vicinity of the V-notch 58 in FIG. 6. Referring again to the left shelf 36 in FIG. 4, it is seen that a cam member 84 is attached thereto. The cam member 84 is in contact with a limit switch 86 when the left shelf has moved downwardly so as to allow the pallet 22 to drop onto the pallet support members 80 and 82. The cam member is depicted in FIG. 2 as being in contact with a limit switch 88 when the left shelf is in an upward position. As will be explained in detail hereinafter, the automatic control utilizes the switches 86 and 88 during the movement of the left shelf 36.

Figure 5:
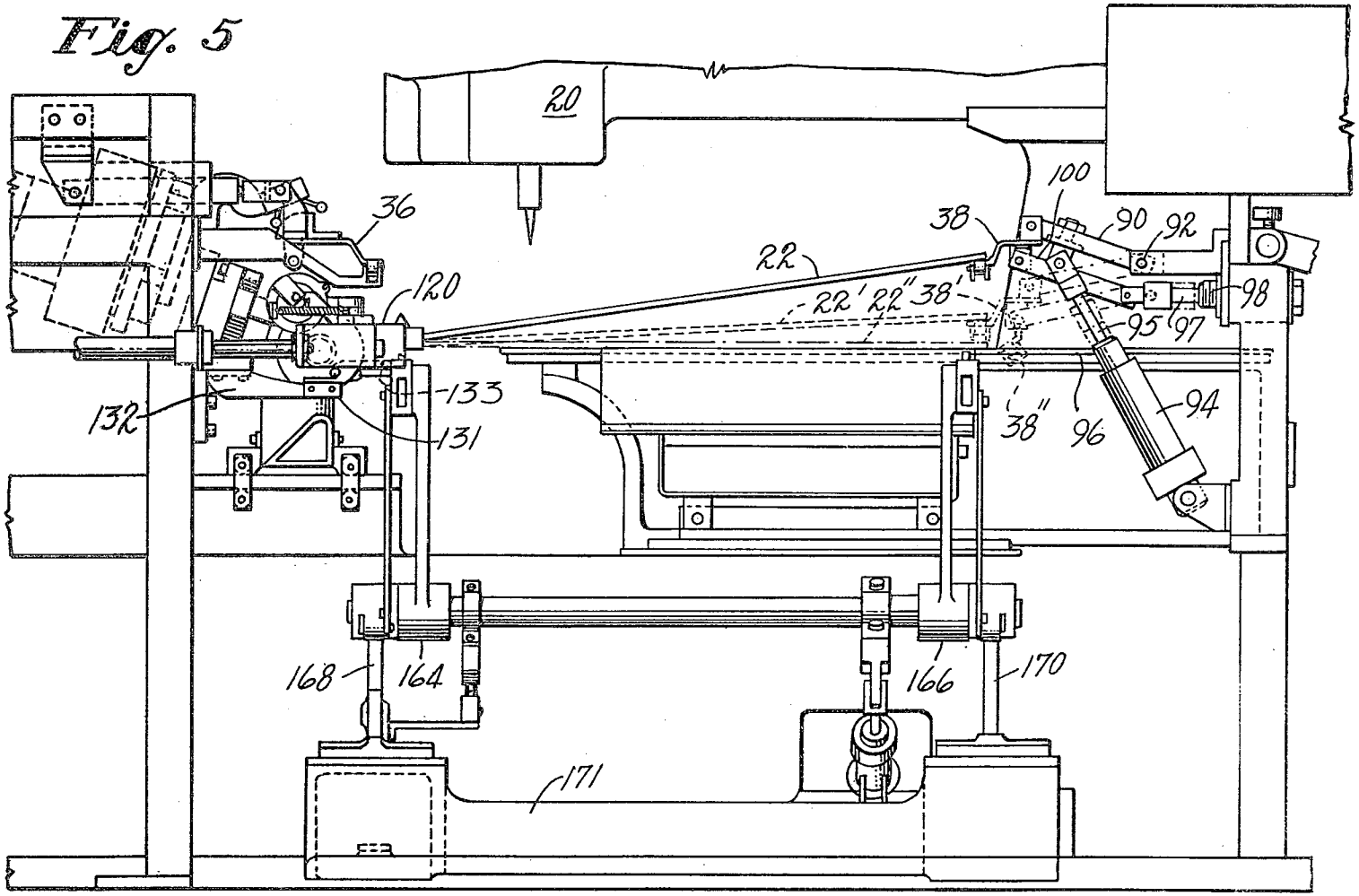
FIG. 5 illustrates the transfer of a pallet within the automatic pallet handling apparatus.

The automatic control is operative to now cause the right side of the pallet 22 to be lowered. Referring to FIG. 5, the right side of the pallet 22 is seen to rest on the right shelf 38 at an elevated position. The right shelf 38 is pivotally connected to an upper bar 90 of a four bar linkage. The upper bar 90 is rotated downwardly about a pivotal point 92 by an air cylinder 94. The retraction of the output shaft 95 of the air cylinder 94 causes the right shelf 38 to assume the position denoted in dotted outline by 38'. The position of the pallet 22 when thus held by the right shelf in the position labelled 38' is illustrated by the dotted outline form labelled 22'. It is to be appreciated that the pallet 22' still rests within the right shelf 38' in this downward position which is only a short distance from the bed 96 of the sewing machine head 20. The pallet 22 is next caused to drop onto the bed 96 by the retraction of an output shaft 98 associated with the air cylinder 98. In this regard, the output shaft 97 associated with the air cylinder 98 is pivotally connected to a lower bar 100 of the double bar linkage. The position of the right shelf 38 following the retraction of the output shaft 97 associated with the air cylinder 98 is illustrated by the dotted outline deonted as 38''. This latter position of the right shelf 38 is such as to completely clear the pallet 22'' which now rests on the reference base 96. The pallet 22'' has now reached the middle position within the pallet handling system. The right shelf 38 can now be rotated upwardly relative to the pivotal point 92 without interferring with the pallet 22'. As will become apparent hereinafter, this latter rotation of the right shelf 38 occurs after the pallet has been clamped by the pallet clamping mechanisms 66 and 68. In any event, the right shelf 38 is reset by first actuating the air cylinder 94 so as to extend the output shaft 95 associated therewith so as to cause the upper bar 90 to rotate about the pivotal point 92. The air cylinder 98 is thereafter actuated so as to extend the output shaft 97 associated therewith so as to thereby cause the lower bar 100 to further position the right shelf upwardly into its reset position.

Once the pallet has assumed the middle position denoted by 22'', it can be clamped by the pallet clamping mechanism 66. Referring to FIG. 4, the elements of the pallet clamping mechanism 66 are illustrated in exploded relationship to one another. The wedge 62 is attached to a pivotal lever 102 which rotates within a fixture 104 forming part of the casting for the carriage 24. Only a portion of the pivotal lever 102 is illustrated within the fixture 104. This portion is seen to include an arm 106 pivotally connected to an output shaft 108 of an air cylinder 110. The output shaft 108 and the air cylinder 110 are clearly shown in FIG. 6. The output shaft 108 is operative to extend outwardly into contact with an adjustable limit stop 112. The outward extension of the shaft 108 causes the pivot lever 102 to rotate about the axis 114 defined by the fixture 104. The rotation of the pivot lever 102 about this axis causes the wedge 62 to move into the notch 58 of the pallet 22 as is shown in FIG. 6. It is to be appreciated that the aforementioned motion of the pivotal lever 102 is against the spring biasing force of a spring 116 connecting the pivotal lever 102 to an eyelet anchor 117 shown in FIG. 6.

It is hence to be appreciated that actuation of the air cylinder 110 causes its output shaft 108 to extend thereby rotating the pivotal lever 102 about the axis 114. This forces the wedge 62 strongly against the notch 58 which in turn urges the notch 60 strongly against the wedge 64. The thus clamped pallet 22 is clearly shown in FIG. 6.

It is to be noted that a heel 118 of the pallet support member 80 is positioned within a cradle 120 in FIG. 6. The cradle 120 is operative to maintain the pallet support member 80 in position below the pallet 22 during the aforementioned clamping or latching operation. The pallet support member 80 is also maintained in place by virtue of a spring 122 attached between a post 124 extending upwardly from the pallet support member 80 and a tab 126 connected to the pivotal lever 102. In this regard, the tensioned spring 122 produces a biasing force on the post 124 which tends to cause the post 124 to engage a rearward curved portion 125 of the pivotal lever 102. This biasing of the post 124 against the curved portion 125 maintains a toe portion of the pallet support member 80 underneath the pallet 22. This position of the pallet support member 80 is maintained during the pattern controlled movement of the pallet 22 with respect to the sewing machine 20. It is to be noted that before the aforementioned movement can take place, it is first of all necessary to move the carriage 24 along the axis 26 so as to remove the pallet support member 80 from within the cradle 120. This is essentially a command of movement in the Y-direction before any movement in the X-direction.

When the pattern stitching has been completed, the X-Y positioning system of FIG. 1 moves the pallet 22 again back to the position illustrated in FIG. 6. At this time, the air cylinder 110 is exhausted. The spring 116 exerts a biasing force on the pivotal lever 102 so as to rotate the pivotal lever about the axis 114. This also causes the shaft 108 to thereby retract within the exhausted air cylinder 110. The result is that the wedge 62 at the end of the pivotal lever 102 disengages from the V-notch 58 within the pallet 22.

Figure 7:
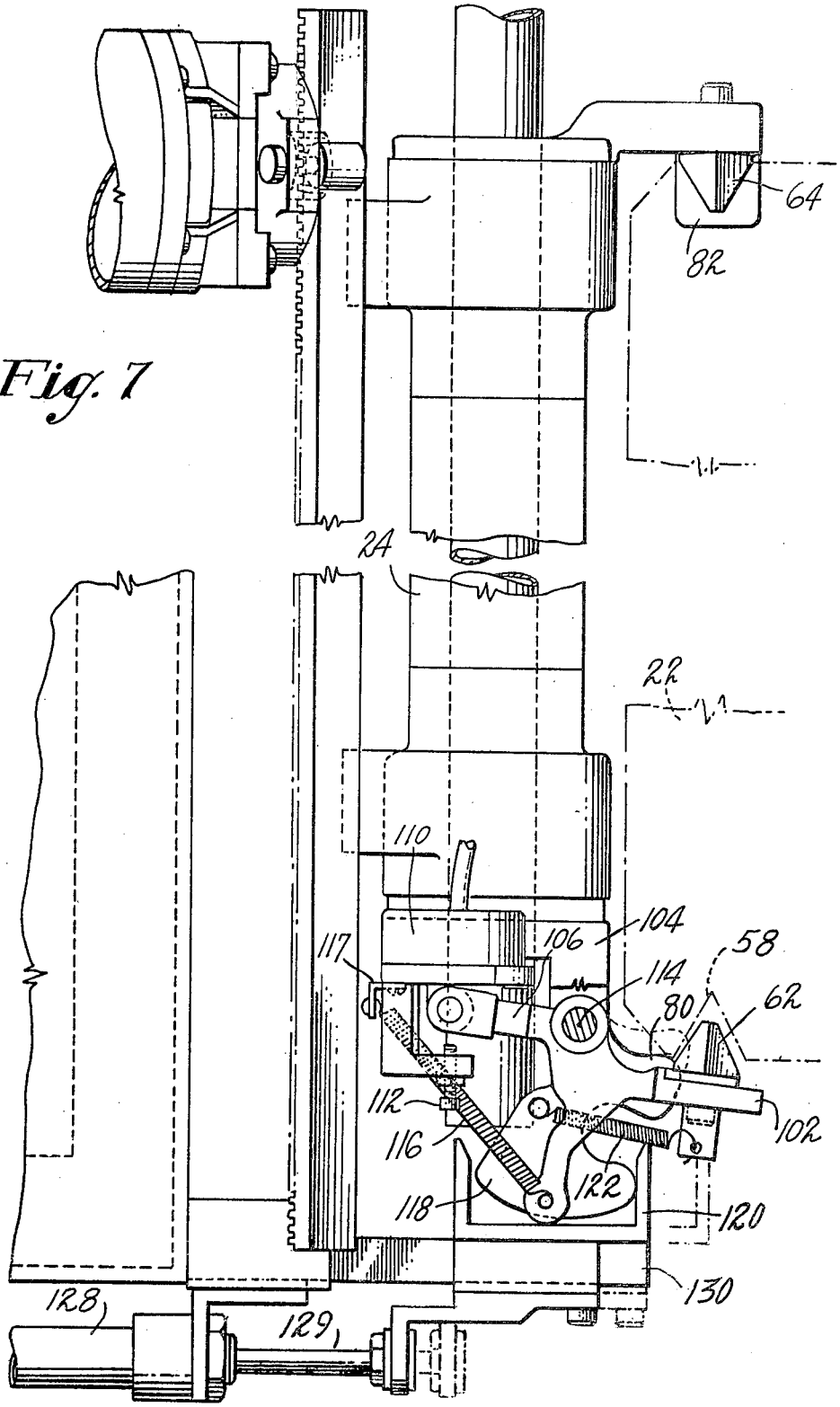
FIG. 7 illustrates the unlocking of the pallet from the carriage of the automatic positioning system.

Referring to FIG. 7, the wedge 62 is illustrated as being withdrawn from the notch 58. FIG. 7 furthermore discloses the actuation of an air cylinder 128 associated with the cradle 120. In this regard, the output shaft 129 of the air cylinder 128 is seen to have moved from a first dotted outline position to a second retracted position. The cradle 120 slides along a guide 130 extending outwardly from the frame of the pallet handling system 34 as is shown in FIG. 4. This movement of the cradle 120 along the guide 130 trips a switch 131. The switch 131 is attached to a downwardly extending member 132 which is connected to the frame of the pallet handling apparatus 34. Referring to FIG. 5, the switch 131 is seen to normally be closed when the output shaft 129 is extended so as to maintain the pallet support 80 in position underneath the pallet. The switch 131 opens when it engages a slot 133 within the slidable attachment to the cradle 120. This later event occurs during retraction of the output shaft 129 which moves the cradle 120 and hence the slot 133 relative to the stationary switch 131 allowing it to open.

The movement of the cradle 120 causes the pallet support member 80 which is registered therein to be rotated backwardly about the axis 133 as is illustrated in FIG. 7. This causes the toe portion of the pallet support member 80 to clear the underside of the pallet 22 as is shown in FIG. 7. The front edge of the pallet 22 now drops downwardly as a result of the removal of the toe portion of the pallet support member 80. The pallet drops down onto a pallet ejector system 134 as shown in FIG. 2. In this regard, a pair of holes 136 and 138 within the pallet 22 are engaged by a pair of aligned pins 140 and 142. The pins 140 and 142 are located on blocks 144 and 146 whose top surfaces stop and support the pallet 22 around the respective holes 136 and 138.

Figure 8:
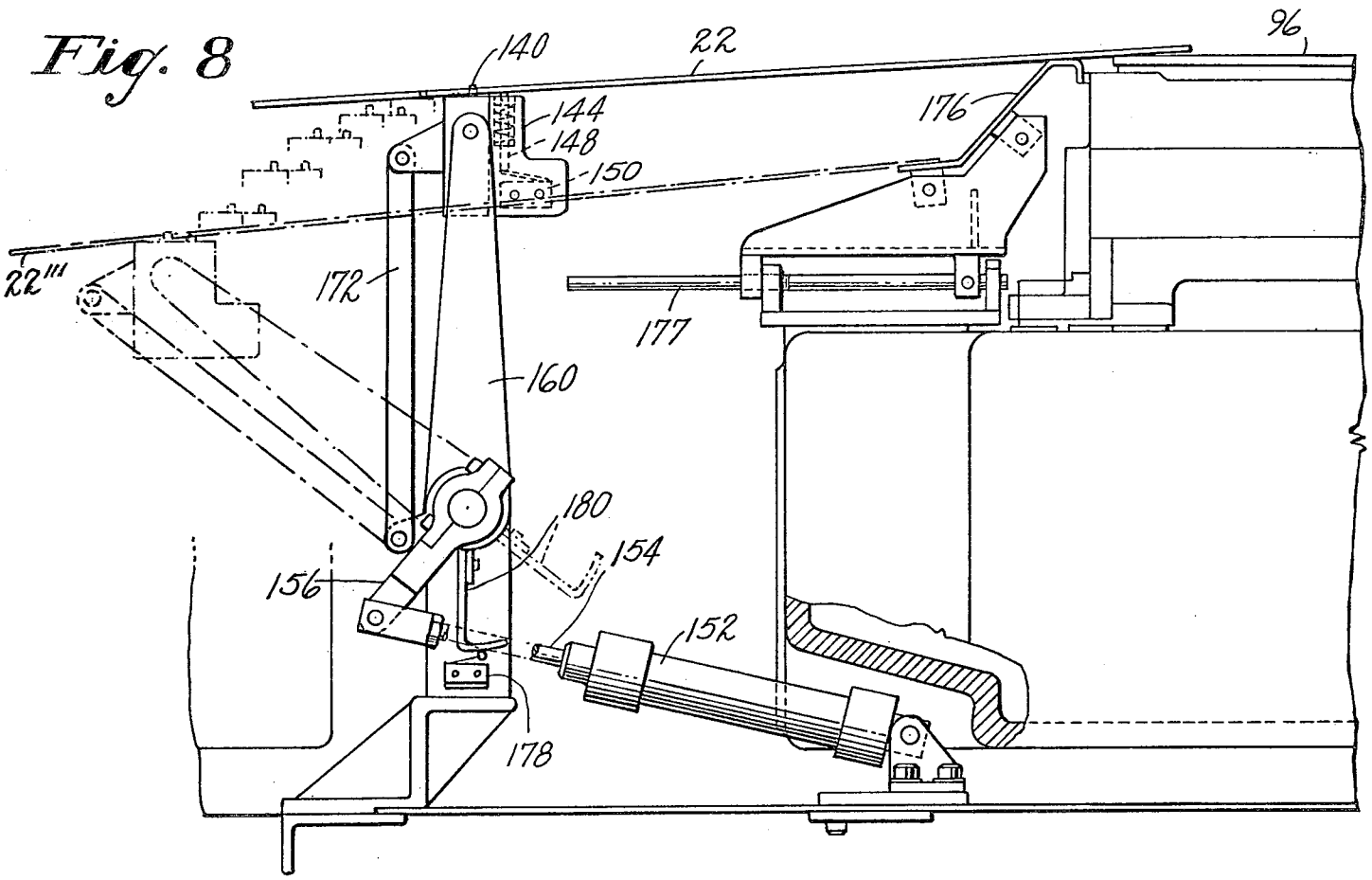
FIG. 8 illustrates the pallet ejector mechanism present within the automatic pallet handling apparatus.

Referring to FIG. 8, the pallet 22 is illustrated as resting on the block 144 with the pin 140 penetrating the hole 136. The block 144 is seen to house a vertical plunger 148 which cooperates with a switch 150 so as to sense the presence of the pallet 22. In other words, when the hole 136 successfully locates over the pin 140, the plunger 148 depresses and closes the switch 150. The switch 150 triggers the automatic control which in turn starts the ejection of the pallet 22. This is accomplished by actuating an air cylinder 152 so as to retract an output shaft 154. The output shaft 154 is pivotally attached to a drive link 156 which is affixed to a shaft 158 of the ejector mechanism. The retraction of the output shaft 154 causes a counter clockwise rotation of the shaft 158. Referring to FIG. 2, the blocks 144 and 146 are seen to be held by a pair of vertical struts 160 and 162 having bases 164 and 166 physically attached to the shaft 158. The shaft 158 in turn is rotatable within a pair of journalled supports 168 and 170 which are affixed to a base 171 illustrated in FIG. 5. The blocks 144 and 146 are pivotally attached to the struts 160 and 162 so as to maintain a proper engagement with the pallet 22 during ejection. The degree of movement of the blocks 144 and 146 with respect to the struts 160 and 162 is limited by a pair of pivotally attached coupling links 172 and 174. In this regard, the coupling links 172 and 174 are each respectively pivotally attached to both the blocks 144 and 146 as well as the journalled supports 168 and 170.

Referring to FIG. 8, the movement of the ejector mechanism 134 during retraction of the output shaft 154 of the air cylinder 152 is illustrated. As has been previously discussed, this causes a rotation of the shaft 158 which in turn moves the struts 160 and 162 outwardly. The ejection path of the block 144 suspended attop the strut 160 and the link 172 is shown in dotted outline form in FIG. 8. The pallet is seen to slide down an adjustable sloped guide surface 176. The sloped guide surface 176 is adjustable along a rail 177 so as to accommodate various sized pallets. When the ejector mechanism 134 has moved the pallet 22 halfway outward, a switch 176 is released by a contact 180 affixed to the shaft 158 as shown in FIG. 2. The contact 180 is configured so as to open the switch 178 when the ejector mechanism 134 is halfway outward. In this regard, the contact 180 actually loses contact with the switch 178 at the halfway point. The contact 180 ultimately assumes a spaced position from the switch 178 as is indicated in dotted outline form. The opening of the switch 178 is a signal to the automatic control that ejection is actually taking place. The pallet is brought outward to a position 22''' that allows the attendant or operator to easily grasp and remove the pallet. This can actually be done during or after the loading of the next pallet into the middle position wherein it is clamped or clocked into the carriage 24. In this manner, the sewing machine 20 does not lose valuable time due to the attendant having to immediately handle the completed pallet 22.

Figure 9:
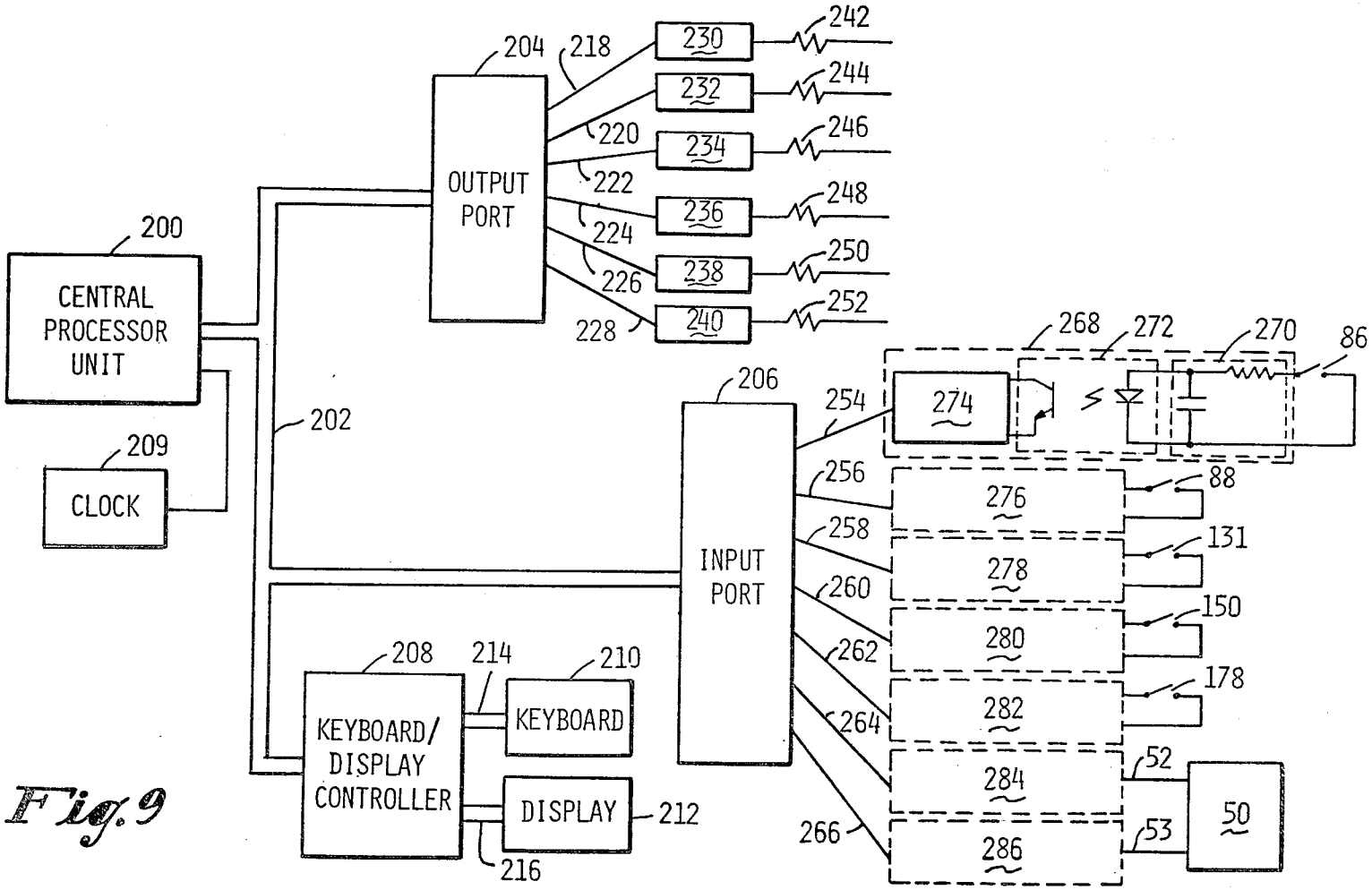
FIG. 9 illustrates the automatic control system associated with the pallet handling apparatus of FIGS. 2–9.

Referring to FIG. 9, an automatic digital control system for the pallet handling system 34 is illustrated. The digital control system is seen to include a programmed central processor unit 200 which is connected via an address and data bus 202 to an output port 204, an input port 206, and a keyboard/display controller 208. The central processor receives a clocking signal for internal timing purposes from a clock 209. The central processor unit 200 is preferably an Intel 8085 microprocessor which is an eight bit microprocessor available from the Intel Corporation. The address and data bus 202 is preferably a multibus available from the Intel Corporation with the Intel 8085 microprocessor. The output port 204 is preferably an interfacing circuit identifiable as an Intel 8212 circuit which is compatible with the address and data bus 202. In a like manner, the input port 206 is an Intel circuit identifiable as an 8255-A and the keyboard/display controller 208 is an Intel circuit 8279.

The keyboard/display controller 208 interfaces with a keyboard 210 and a display 212. The keyboard can be any of a variety of commercially available keyboards interfacing with the controller 208 via a control bus 214. In this regard, the keyboard/display controller 208 merely scans the eight bits of information available over the control bus 214 and stores the same for subsequent communication with the central processor unit 200 via the address and data bus 202. It is to be noted that the keyboard/display controller 208 will be receiving eight bits of ASCII coded information from the keyboard 210 via the control bus 214. The ASCII code is a standard eight bit binary code for various keys present on commercially available keyboards. It is to be furthermore noted that the keyboard/display controller 208 will transmit keyboard information to the central processor unit 200 in ASCII code. The central processor 200 will convert the thus received information for its internal processing. Any transmittal of information back to the keyboard/display controller 208 will be previously coded in ASCII by the central processor 200. The keyboard/display controller 208 receives the ASCII coded character information from the central processor 200 via the address and data bus 202 and provides character generation information to the display 212 via a display bus 216 in a well-understood manner. It is to be understood that the display 212 can be any of a number of commercially available displays capable of responding to character generation information from the keyboard-/display controller 208.

The output port 204 is seen to have six separate bilevel signal outputs identifiable as 218 through 228. The signals from the bilevel signal outputs 218 through 228 are applied to solid state relays 230, 232, 234, 236, 238 and 240. Each relay respectively converts a logically high bilevel signal applied thereto to a 24 volt AC signal that can be applied to a respective solenoid associated therewith. It is to be understood that each solenoid governs the action of a pneumatic valve associated with one of the pneumatic air cylinders present in the pallet handling system. A valve can either exhaust or admit air into the respective air cylinder in response to the 24 volt AC signal being impressed on its solenoid. The particular air cylinder and corresponding valve action is a matter of arbitrary choice according to the present invention since the bilevel signal condition present on the respective bilevel outputs 218 through 228 can either be set logically high or logically low to accomplish the appropriate action of the air cylinder. In other words, if it is necessary to issue a logically high signal at a particular bilevel output so as to impress a 24 volt AC signal on the corresponding solenoid in order to obtain an extension of the output shaft of the respective air cylinder, then such a signal would issue when the extension was desired. On the other hand, a commercially available pneumatic air cylinder requiring a lack of solenoid excitation for the extension of the output shaft would experience an appropriate logically low signal condition at the corresponding bilevel output. Accordingly, the signal conditions present at the respective bilevel outputs 218–228 will hereinafter be described in terms of the desired effect, namely, extension or retraction of the output shaft of the respective air cylinder.

Referring again to the specific solenoids in FIG. 9, it is to be noted that a solenoid 242 controls the pneumatic action of the air cylinder 70. It will be remembered that the air cylinder 70 dictates the movement of the left shelf 36. In like manner, the solenoid 244 controls the pneumatic air cylinder 94 associated with the right shelf 38. Solenoid 246 is associated with pneumatic air cylinder 98 which controls the withdrawal of the right shelf 38. Solenoid valve 248 is associated with pneumatic air cylinder 110 which controls the pallet clamping mechanism 66. Solenoid valve 250 is associated with air cylinder 128 which controls the movement of the cradle 120. Finally, a solenoid valve 252 controls the air cylinder 152 associated with the pallet ejector mechanism 134.

The input port 206 receives seven logic level signals at bilevel signal inputs 254, 256, 258, 260, 262, 264, and 266. Each bilevel signal input receives a logic level signal from a respective buffer circuit associated with a switch within the pallet handling mechanism 34. Referring first to the bilevel signal input 254, it is seen that a buffer circuit 268 provides a bilevel signal to this input in response to the closing of the switch 86. It will be remembered that the closed switch 86 indicates a downward position of the left shelf 36. The buffer circuit 268 is seen to comprise a noise filter circuit 270 in combination with an optical isolator circuit 272 and a bounce filter circuit 274. The noise filter 270 merely filters the electrical noise from the switch signal whereas the optical isolator 272 provides a further isolated signal that is applied to the conventional bounce filter circuit 274 which samples the signal from the optical isolator and provides an appropriate output signal only when the sampled signal is consistent for a period of time approximating 20 milliseconds. In this manner, an appropriate bilevel signal is applied to the bilevel signal input 254 of the input port 206.

The signal state of the bilevel signal input 254 is preferably logically low for a closed switch condition. In this regard, the switch 86 is preferably an electronic switch which generates a logically high signal condition when closed. This signal state is inverted by the various circuits comprising the buffer circuit 268. This results in a logically low signal state at the bilevel signal input 254 for the closed switch condition. It is to be noted that this signal conversion will prevail for the other bilevel signal inputs which are connected through respective buffer circuitry to various switches within the pallet handling system. This signal conversion need not however be followed in practicing the invention if the significance of a given state at a given bilevel input is taken into account within the software program resident within the central processor 200.

A buffer circuit 276 having the same internal configuration as that of buffer circuit 276 is connected to the switch 88. It will be remembered that the switch 88 defines an upward level position of the left shelf 36 when closed. The buffer circuit 276 is operative to produce a logically low bilevel signal to the bilevel signal input 256 in response to a closure of the switch 88.

A buffer circuit 278 processes the signal condition of the switch 131 through to the bilevel signal input 258. It will be remembered that the switch 131 closes when the cradle 120 is positioned outwardly so as to reset the pallet support 80 for subsequent support of a received pallet.

A buffer circuit 280 processes the signal condition of the switch 150 through to the bilevel signal input 260. It will be remembered that the switch 150 closes when the pallet has been engaged by the pallet ejector mechanism 134. This closed switch condition results in a logically low bilevel signal input 260.

A buffer circuit 282 processes the signal condition of the switch 178 through to the bilevel signal input 262. It will be remembered that the switch 178 opens when the pallet has been moved halfway to the extreme outward position by the ejector mechanism 134. This results in a logically high bilevel signal input 262.

A pair of buffer circuits 284 and 286 receive bilevel signals present on the lines 52 and 53 from the pallet identification sensor 50. It will be remembered that these bilevel signals will both be logically high when a pallet is present and logically low when a pallet is not present on the left and right shelves 36 and 38. The signal states are inverted through the respective buffer circuits 284 and 286 so as to result in logically low bilevel signal inputs 284 and 286 when a pallet is present and the reverse when a pallet is absent.

As has been previously noted, the buffer circuit 276 is comprised of the same three elements as the buffer circuit 268, namely, a noise filter, optical isolator and bounce filter set of circuits. This can also be said of the buffer circuits 278, 280, 282, 284 and 286.

Referring now to FIG. 10, a flow chart of a program resident in the main memory of the central processor 200 is illustrated for the loading of a pallet into the pallet handling system 34. The program begins with a question 300 as to whether a START command has been entered on the keyboard 210. This is merely ascertained by the central processor 200 addressing the keyboard-/display controller 208 and querying the thus addressed controller as to whether or not a START key has been depressed on the keyboard 210. In accordance with the invention, the START key can be any arbitrarily assigned key on a commercially available keyboard. The program merely notes the ASCII code for this particular key and questions when this code is present in the keyboard/display controller 208. The central processor unit 200 merely keeps recycling and asking for a START command. This is indicated by the NO loop associated with the step 300 in the flow chart of FIG. 10.

When the START command is received, the central processor 200 proceeds to a step 301 and sets a FLAG A equal to zero. This software flag is utilized by a PALLET UNLOAD program in a manner which will be described hereinafter. The central processor 200 next issues a RETRACT command signal to the bilevel output 224 of the output port 204 as is indicated by the step 302 in FIG. 10. This is accomplished by specifically addressing the output port 204 and thereafter transmitting an appropriate logic level signal thereto. As has been previously discussed, the signal state of the logic level signal will depend on the configuration of the pneumatic air cylinder that is to be actuated. If the air cylinder is to be exhausted so as to retract the output shaft when the solenoid is deenergized, then the signal at bilevel output 224 will be logically low. On the other hand, if the solenoid must be energized to exhaust the air or if the air must be admitted to retract the output shaft, then the command signal at the bilevel output 224 would be logically high. In any event, the appropriate logic level command signal is generated by the programmed computer and applied to the solid state relay 236. This in turn appropriately energizes or deenergizes the solenoid 248 associated with the air cylinder 110. The net result is that the output shaft 108 of the air cylinder 110 is retracted so as to release the clamping mechanism 66. It is to be noted that the clamping mechanism 66 may already have been released. In this instance, the issuing of the RETRACT command merely is a redundant check on the status of the pallet clamping mechanism 66.

The next step 304 of the central processor 200 is to issue an EXTEND command signal to the bilevel output 218 of the output port 204. This triggers the solid state relay 230 so as to apply a signal condition to the solenoid 242 which allows an outward extension of the shaft 72 associated with the air cylinder 70. Referring to FIG. 4, the outward extension of the shaft 72 results in the left shelf 36 being lowered. The central processor 200 awaits the tripping of the switch 86 which occurs when the left shelf 36 is fully downward. In this regard, the closed switch condition 86 is filtered by the noise filter 270 isolated by the optical isolator 272 and thereafter retained by the bounce filter 274 so as to result in a logically low signal level condition being applied to the bilevel signal input 254. This logically low signal level will be detected by the central processor unit 200 in the step 306 within the flow chart of FIG. 10.

Following a confirmation that the left shelf 36 is down, the central processor 200 issues a RETRACT command signal at the bilevel output 220 of the output port 204 as is indicated by step 308. This RETRACT command triggers the solid state relay 232 so as to apply a signal condition to the solenoid 244 which allows the output shaft 95 of the air cylinder 94 to retract. Referring to FIG. 5, it will be remembered that the retraction of the output shaft 95 of the air cylinder 94 allows the right shelf 38 to be lowered so as to drop the right edge of the pallet from the top input position.

Referring again to the flow chart of FIG. 10, it is noted that the central processor unit counts out a delay of 200 milliseconds in a step 310. This defines an appropriate time for the right shelf 38 to assume the downward position. It is to be noted that the counting out of the delay is accomplished by establishing a count and thereafter decrementing the count by the clock signal from the clock 209.

Following the assumption of a downward position by the right shelf 38, the central processor 200 in a step 312 issues a RETRACT command signal at the bilevel output 218 of the output port 204. This reverses the signal state of the solid state relay 230 so as to apply a signal condition to the solenoid 242 which allows the output shaft 72 associated with the air cylinder 70 to retract and hence raise the left shelf 36. Referring to FIG. 4, the switch 88 is contacted when the left shelf assumes an upward position. The closed signal state of the switch 88 results in a logically low signal state being applied to the bilevel input 256 via the buffer circuit 276. This logically low signal state at the bilevel input 256 is noted by the central processor 200 which addresses the input port 206 and asks whether the bilevel signal input signal 256 has switched low. This is accomplished in a step 314 in FIG. 10.

The central processor 200 next issues a RETRACT command signal in a step 316 to the bilevel output 222 of the output port 204. Referring to FIG. 9, the relay 234, associated with the bilevel output 204, provides a signal condition on the solenoid 246 which results in a retraction of the output shaft of the air cylinder 98. As is seen in FIG. 5, this results in a withdrawal of the right shelf 38. This latter movement of the right shelf 38 allows for an appropriate clearance of the pallet 22 which now rests on the reference base 96. This constitutes the middle position for a pallet within the pallet handling system.

Referring again to FIG. 10, it is seen that the central processor 200 sets up a first delay count of 430 milliseconds in a step 318 following the issuance of the RETRACT command signal at the bilevel output 222. It will be remembered that the clock 209 provides a clock signal to the central processor 200 for the purpose of timing out a delay established by the central processor 200. While the central processor is thus timing out the delay, it also issues an EXTEND command signal in a step 320 to the bilevel output 224 of the output port 204. This triggers the solid state relay 236 so as to apply a signal condition to the solenoid 248 which causes the output shaft 108 of the air cylinder 110 to move outwardly. Referring to FIG. 6, this results in the pivotal lever 102 rotating about the axis 114 so as to apply a clamping pressure to the pallet which has been previously dropped onto the pallet supports 80 and 82. As a result of the clamping action, the pallet is now mated to the carriage 24 and is ready for subequent positioning under the sewing machine head 20. Before any such positioning can occur, it is first of all necessary for the first delay count to have timed out indicating that the right shelf 38 has in fact reached a withdrawn position. This is provided for by the step 322 calling for the delay count to have been timed out in FIG. 10.

Following the timing out of the first delay, the central processor 200 is operative in a step 324 to issue an EXTEND command signal to the bilevel output 220 of the output port 204. This command triggers the solid state relay 232 so as to apply a signal condition to the solenoid 244 which causes the output shaft 95 of the air cylinder 94 to extend upwardly. This in turn causes the right shelf 38 to move upwardly as is shown in FIG. 5. The central processor 200 sets up a second delay count of 430 milliseconds in a step 326 and times out the second delay count so as to allow adequate time for the movement of the output shaft 95 of the air cylinder 94. The timing out is accomplished by a step 328 which utilizes the clocking signal from the clock 209 to time out the count of 430 milliseconds established in the step 326.

The central processor thereafter in a step 330 issues an EXTEND command signal at the bilevel output 222 of the output port 204. This triggers a solid state relay 234 so as to apply a signal condition to the solenoid 246 which causes an outward extension of the output shaft 97 of the air cylinder 98 as is shown in FIG. 5. This constitutes the final step in resetting the right shelf 38 to its upward position. The central processor 200 has now sequenced the left shelf 36 and right shelf 38 through a complete set of movements so as to drop the pallet to the middle position within the pallet handling system 34. The central processor 200 has moreover clamped the thus delivered pallet to the carriage 24 and reset both the left shelf 36 and the right shelf 38. This will allow for the loading of an additional pallet onto the thus reset shelves.

The central processor 200 is operative to call for the movement of the clamped pallet while another pallet is being loaded onto the reset shelves 36 and 38. In accordance with the invention, the movement of the pallet can actually occur as early as the end of step 320. At this point, the withdrawing of the right shelf 38 does not interfere with the movement of the pallet 22. The resetting of the right shelf 38 from a withdrawn and lowered position, as dictated by steps 324 to 330, will also not interfere with the movement of the pallet. The only requirement relative to the initial movement of the pallet is that the carriage 24 first be moved along the axis 26 in the Y-direction toward the sewing machine head 20. This initial movement will disengage the heel 118 of the pallet support from the cradle 120 in FIG. 6.

It is to be appreciated that a motion control program for the aforementiond movement resides in the main memory of the central processor 200. This motion control program utilizes a stored file of stitch pattern information which dictates the synchronized movement of the pallet containing a workpiece underneath a reciprocating sewing needle within the sewing head 20. This is identified broadly as the STITCH MODE in FIG. 10. Following the successful execution of a desired stitch pattern, the pallet containing the finished workpiece is returned to the position illustrated in FIG. 6. This requires a final movement of the carriage 24 along the axis 26 so as to reposition the heel 118 of the pallet support within the cradle 120. This is preparatory to further processing of the clamped pallet by the pallet handling system.

Figure 11:
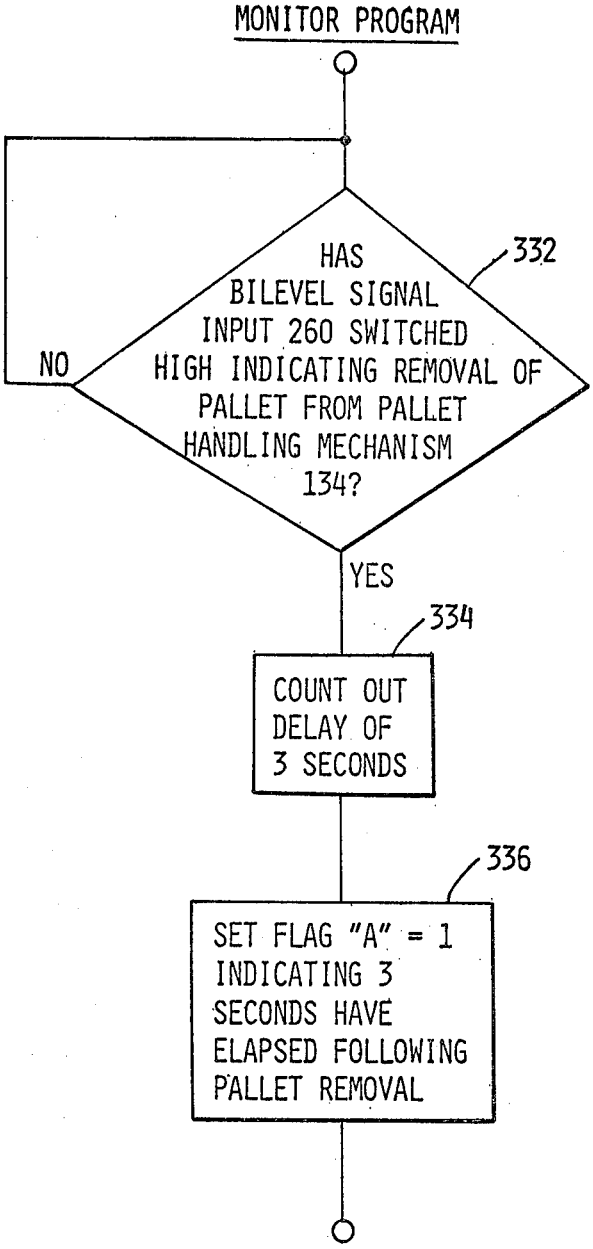
FIG. 11 illustrates the flow of computer commands within the automatic control system of FIG. 9 so as to monitor the removal of an ejected pallet.

Referring now to FIG. 11, a MONITOR program is illustrated in flow chart form. This MONITOR program resides in the central processor unit 200 and is moreover active during the aforementioned stitching mode. In this regard, the MONITOR program is periodically executed for the purpose of ascertaining the status of any pallet that is to be removed by the operator or machine attendant. It will be remembered that the pallet handling system 34 has the capability of moving a finished pallet to an outward position for removal by the operator. The control for this particular processing of the pallet will be explained in detail hereinafter. For the moment, it is merely necessary to note that a pallet may in fact be present on the pallet handling mechanism 134. In this regard, the MONITOR program of FIG. 11 begins with a step 332 wherein the central processor 200 addresses the input port 206 and asks whether or not the bilevel signal input 260 has been switched high. Referring to FIG. 8, it will be remembered that a pallet resting on the block 144 of the pallet handling mechanism 134 will cause a plunger 148 to close a switch 150. This closure of the switch 150 will be processed by the buffer circuit 280 so as to produce a logically low signal condition at the bilevel input 260. As long as this logically low signal condition exists, the central processor 200 merely addresses the bilevel signal input 260 and does nothing further. On the other hand, when the bilevel signal input 260 switches logically high, the central processor 200 counts out a delay of three seconds as is indicated in a step 334 in FIG. 10. This is accomplished by setting up a count of three seconds and allowing the clock 209 to decrement the count to zero. At this time, the central processor sets a FLAG A equal to binary one in a step 336. This provides an indication that three seconds have elapsed following removal of the pallet by the operator. As will become apparent hereinafter, this three second delay is used to trigger the resetting of the pallet ejector mechanism 134. The lapse of three seconds allows the operator sufficient time to remove the pallet before the pallet ejector mechanism 134 begins this reset motion.

Figure 12A:
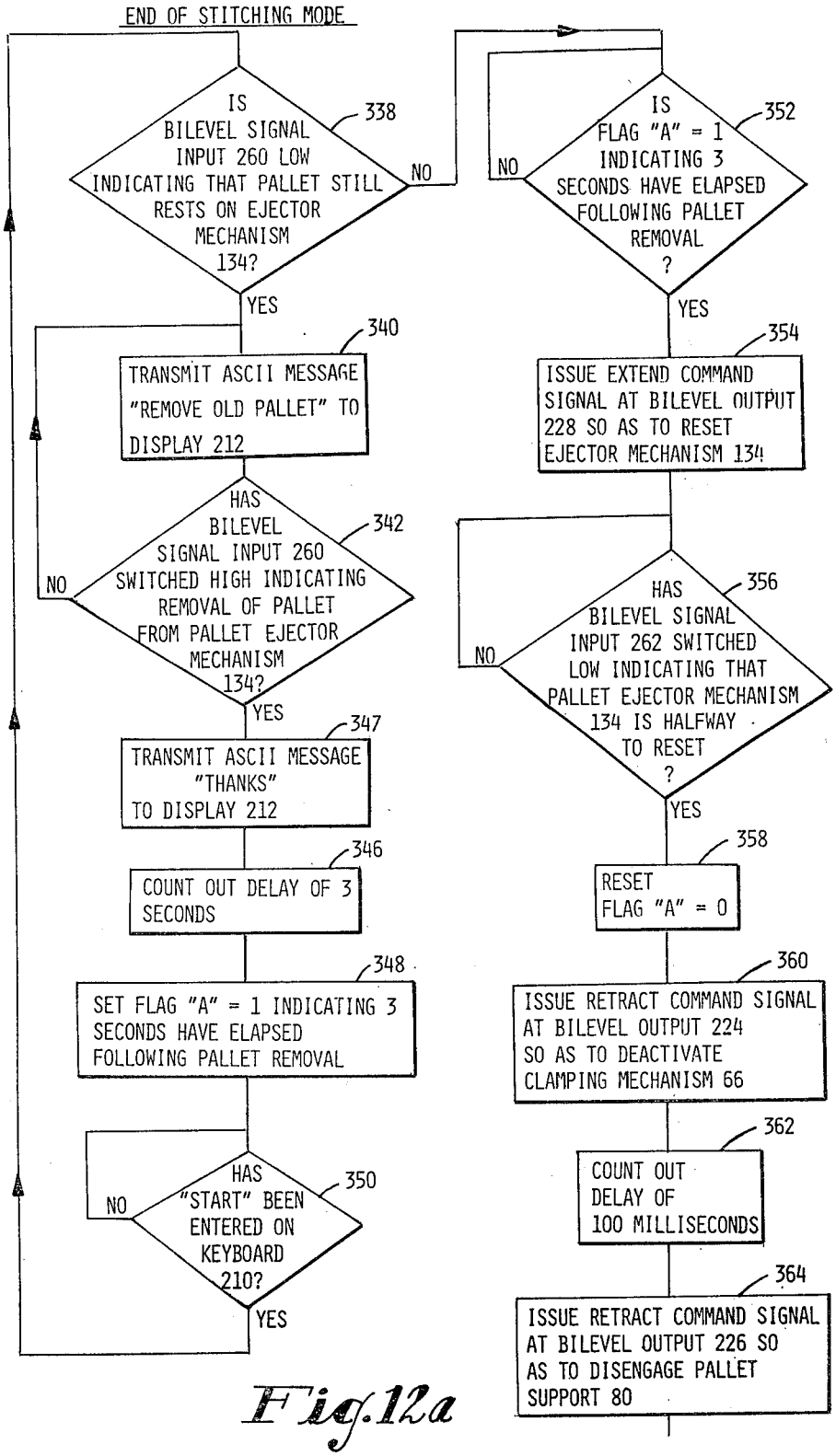
FIGS. 12*a* and 12*b* illustrate the flow of computer commands within the automatic control system of FIG. 9 so as to facilitate the unloading of a pallet.
Figure 12B:
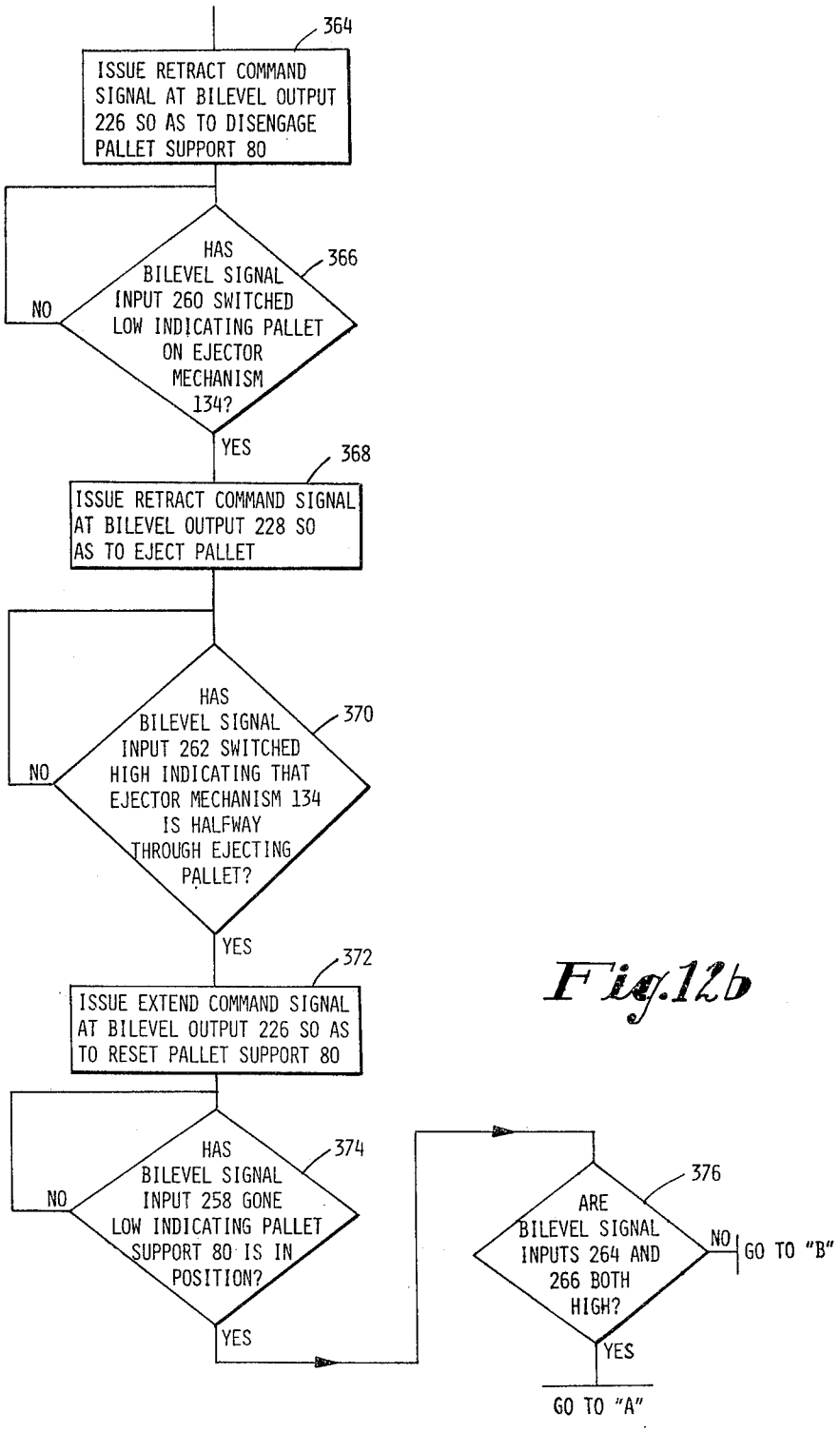

Referring now to FIGS. 12*a* and 12*b*, a flow chart depicts a PALLET UNLOAD program which dictates the sequential operation of the central processor 200 during a pallet unloading sequence. In this regard, a previously loaded pallet has been presented to the sewing machine head 20 for sewing and is now ready for the pallet unloading sequence. This is indicated by an end of stitching mode notation in FIG. 12*a*. It is to be understood that the end of stitching mode juncture depicted in FIG. 12*a* would include the repositioning of the heel 118 of the pallet support within the cradle 120 as is shown in FIG. 6.

The first inquiry made by the central processor 200 is to ask whether the bilevel signal input 260 is logically low in a step 338. It will be remembered from the previous discussion of FIG. 11, that the bilevel signal input 260 is logically low when the switch 150 associated with the pallet handling mechanism 134 is close indicating that a pallet still rests on the ejector mechanism 134. If the pallet has not been removed by the operator during the course of the stitching mode, then the central processor 200 follows the "YES" path in FIG. 12*a* to a step 340 and transmits the ASCII coded message "REMOVE OLD PALLET" to the display 212. As has been previously discussed, the central processor 200 communicates with the keyboard/display controller 208 over the address and data bus 202 in the standard ASCII code. The keyboard/display controller 208 in turn transmits character generator signals over a display bus 216 to the display 212. The message is thereafter displayed in normal fashion on the display 212.

The central processor 200 now asks in step 342 whether the bilevel signal input 260 has switched high indicating removal of the pallet from the pallet handling mechanism 134. If the pallet still remains on the pallet handling mechanism 134, the "NO" path is pursued back to step 340 and the "REMOVE OLD PALLET" message is again transmitted to the display 212. The bilevel signal input 260 will again be addressed by the central processor 200 to ascertain whether or not the input signal has switched logically high indicating the removal of the pallet from the pallet handling mechanism 134. When this finally occurs, the "YES" path is pursued and the central processor 200 transmits ASCII message "THANKS" to the display 212 in a step 344. The central processor 200 now counts out a delay of three seconds in a step 346 and thereafter sets a FLAG A equal to binary one in a step 348. It will be remembered that this sequence of steps assures that the operator will be allowed sufficient time to remove the pallet.

Following the setting of the FLAG A equal to one, the central processor thereafter asks the keyboard/display controller 208 in a step 350 whether or not a "START" has been entered on the keyboard 210. The central processor 200 awaits the "START" signal from the keyboard 210 before following the "YES" path back to step 338. It will be noted that the loop which has just been discussed in premised on the pallet not having been unloaded at the end of the stitching mode. This requires that the machine be again started by the operator as is evidenced by the step 350 requiring a "START" authorization again. This program loop is avoided if the pallet has been previously removed prior to the end of stitching mode. In this regard, the bilevel signal input 260 will be logically high causing a "NO" answer to the inquiry by the central processor 200 in step 338. The "NO" path will hence be followed from the step 338 to a step 352 in FIG. 12*a*. The step 352 calls for the central processor 200 to ask whether or not the FLAG A is equal to one indicating that three seconds have elapsed following removal of the pallet. It will be remembered that the FLAG A does not indicate a binary one signal condition until three seconds have elapsed so as to allow the operator to remove the pallet. This could still be timing out in the event that the MONITOR program began counting out three seconds towards the end of the stitching mode. In any event, the central processor 200 awaits the setting of the FLAG A equal to one. When this occurs, the central processor in a step 354 issues an EXTEND command signal at the bilevel output 228 of the output port 204. Referring to FIG. 9, the presence of an EXTEND command signal at the bilevel output 228 triggers the solid state relay 240 so as to apply a signal condition to the solenoid 252 which causes the output 154 of the air cylinder 152 to extend. This extension of the output 154 of the air cylinder 152 causes the ejector mechanism 134 to rotate backwardly to its reset position.

The central processor 200 next asks in a step 356 whether the bilevel signal input 262 has switched low. Referring to FIG. 9, it is seen that the bilevel signal input 262 receives a buffered signal from the switch 178 through the buffer circuit 282. The switch 178 closes when the ejector mechanism 134 has moved inward halfway. This closed switch condition will result in the logically low signal state being indicated at the bilevel input 262. When the ejector mechanism has thus been sensed as having moved halfway inwardly, the central processor 200 resets the FLAG A equal to zero in a step 358.

The central processor 200 next issues a RETRACT command signal to the bilevel output 224 of the output port 204 in step 360. This triggers the solid state relay 236 so as to apply a signal condition to the solenoid 248 resulting in the retraction of the output shaft 108 associated with the air cylinder 110. This deactivates the clamping mechanism 66 as has been previously discussed with regard to FIG. 7. Specifically, the wedge 62 is disengaged from the groove 58 of the pallet 22. The pallet now merely lies on the pallet supports 80 and 82 as well as the reference base 96. Referring again to FIG. 12*a*, the central processor 200 assures that the aforementioned action has occurred by counting out a delay of 100 milliseconds in a step 362 following issuance of the RETRACT command to the bilevel output 224 in step 360. When the delay has thus been timed out, the central processor in a step 364 issues a RETRACT command signal to the bilevel output 226 of the output port 204. Referring a FIG. 9, the RETRACT command signal present at the bilevel output 226 triggers the solid state relay 238 so as to apply an appropriate signal condition to the solenoid 250. This allows the output 129 of the air cylinder 128 to retract so as to cause the cradle 120 housing the heel 118 of the pallet support to move backward in the manner shown in FIG. 7. The toe of the pallet support 80 is moved out from underneath the pallet so as to allow the pallet to drop downward at its front edge.

Referring now to FIG. 12*b*, it is seen that the flow chart depicted therein is a continuation of the sequential logic illustrated in FIG. 12*a*. In particular, it is to be noted that the first step of FIG. 12, namely, step 364 is merelly a repeat of the last step performed by the central processor 200 in FIG. 12*a*. The next step 366 to be implemented by the central processor in FIG. 12*b* is that of asking whether or not the bilevel signal input 260 has switched low. Referring to FIG. 9, it is seen that the bilevel signal input 260 receives a buffered signal from the switch 150. The bilevel signal input will be logically low when the switch 150 has closed. It will be remembered from the discussion of FIG. 8 that the switch 150 is closed when a pallet rests on the pallet ejector mechanism. When this condition occurs, the "YES" path is pursued in FIG. 12*b*. The central processor 200 next issues a RETRACT command at the bilevel output 228 in a step 368. This RETRACT command present at the bilevel output 228 triggers a solid state relay 240 so as to apply a signal condition to the solenoid 252 which retracts the output shaft 154 of the air cylinder 152 in FIG. 8. This retraction causes the ejector mechanism 134 to move outwardly so as to transport the pallet to a position whereby it may be removed by the operator of the machine. The outward ejection motion is monitored by the central processor 200 in a step 370 which asks whether the bilevel signal input 262 has switched logically high. In this regard, the switch 178 switches open when the pallet ejector mechanism 134 is halfway through its outward motion. When the bilevel signal input 262 has switched high, the central processor 200 issues an EXTEND command to the bilevel output 226 in a step 372. Referring to FIG. 9, this triggers the solid state relay 238 so as to apply a signal condition to the solenoid 250 which extends the output 129 of the air cylinder 128. This causes the cradle 120 to engage the heel 118 of the pallet support so as to move the pallet support 80 back into a reset position. This position is illustrated in FIG. 6. The reset position of the pallet support 80 allows a pallet to be supported between the pallet support 80 and the pallet support 82. Referring to step 374 of FIG. 12*b*, the central processor 200 checks to see whether or not the pallet support 80 is in fact in position. This is accomplished by asking whether or not the bilevel signal input 258 has gone logically low. In this regard, the switch 131 associated with the cradle 120 will have closed when the output shaft 129 is fully extended. When this signal condition occurs, the central processor 200 proceeds to the next step within the flow chart of FIG. 12*b*.

The next step 376 is an inquiry as to the signal status of the bilevel signal inputs 264 and 266. It will be remembered that the bilevel signal inputs 264 and 266 receive the buffered signal conditions of the signals present on the lines 52 and 53. It will furthermore be remembered that the signals on the lines 52 and 53 will be logically low when a pallet code has not been registered with the pallet identification sensor 50 in FIG. 3. The signal conditions will be inverted through the buffer circuits 284 and 286 so as to produce logically high signal conditions at the bilevel inputs 264 and 266 in FIG. 9. It will also be remembered that the signals on the lines 52 and 53 will be logically high if a pallet code has been registered with the pallet identification sensor 50. This will produce logically low signal conditions at the bilevel signal inputs 264 and 266. The central processor 200 is hence able to ascertain whether there is a pallet present on the shelves 36 and 38 by asking if both bilevel signal inputs are logically high in step 376. In the event that a pallet is not present, the "YES" path is pursued out of step 376 to junction "A" in FIG. 10. Referring to FIG. 10, it is seen that junction "A" is upstream of step 300. Step 300 requires the central processor 200 to await a START command from the operator. The START command will of course issue only after the operator has plaaced a pallet on the shelves 36 and 38.

Referring to FIG. 12*b*, if a pallet in fact rests on the shelves 36 and 38 at the end of the pallet unloading, then at least one of the bilevel signal inputs 264 or 266 will be logically low. This will allow the central processor 200 to pursue the "NO" path to junction "B" within the flow chart of FIG. 10. This will result in an automatic pallet loading sequence to occur as is dictated by the pallet loading sequence of FIG. 10. This automatic pallet loading sequence will occur without need of operator intervention. In this manner, pallets can be continually automatically sequenced through the pallet handling system 34 without any stoppage or delay.

From the foregoing, it is to be appreciated that a preferred embodiment of an automatically controlled pallet handling system has been herein disclosed. It is to be appreciated that alternative control logic and associated mechanical apparatus may be substituted for elements of the preferred embodiment without departing from the scope of the invention. It is also to be appreciated that the automatic controlled pallet handling system herein disclosed may be interfaced with other digital control system logic such as is disclosed in U.S. patent application Ser. No. 266,298 filed May 22, 1981, entitled "Sewing Machine System Having Automatic Identification and Processing of Mounted Work", filed on even date herewith in the names of Herbert Johnson, Richard M. Elliott, Donald F. Herdeg and Alan M. Peck.

What is claimed is:

1. In an automatic sewing machine system, apparatus for automatically processing a plurality of workpieces prearranged within pallets, said apparatus comprising:

means for receiving a prearranged workpiece within a pallet;

means, located below said receiving means, for automatically attaching a pallet transmitted from said receiving means to a means for automatically positioning the prearranged workpiece relative to a sewing needle so as to produce a sewn workpiece;

means located below said automatic positioning means, for automatically ejecting the pallet containing the sewn workpiece; and means for automatically controlling said receiving means, said automatic attaching means, and said automatic ejecting means so as to process received pallets.

2. The apparatus of claim 1 wherein said means for receiving a prearranged workpiece within a pallet comprises:

a pair of independently operable shelves spaced apart so as to receive and suspend the pallet in a position above said automatic attaching means.

3. The apparatus of claim 2 wherein said pair of independently operable shelves comprises:

a first shelf for supporting a first edge of a received pallet, said first shelf being rotatable about a first axis; and means for rotating said first shelf about said first axis so as to drop the first edge of the received pallet in response to a signal from said automatic control means.

4. The apparatus of claim 3 wherein said pair of independently operable shelves further comprises:

means for detecting when said first shelf has been rotated so as to drop the first edge of the received pallet whereby said automatic control means is operative to subsequently issue a reset signal to said means for rotating said first shelf about said first axis; and means for detecting when said first shelf has been reset and for transmitting the reset status to said automatic control means.

5. The apparatus of claim 3 wherein said pair of independently operable shelves further comprises:

a second shelf for supporting a second edge of a received pallet; and means, responsive to a signal from said control means for moving said second shelf downwardly so as to lower the second edge of the received pallet following the dropping of the first edge of the received pallet.

6. The apparatus of claim 5 wherein said means for moving said second shelf downwardly is operative to move said second shelf upwardly in response to at least one reset signal from said automatic control means.

7. The apparatus of claim 5 wherein said means for automatically positioning the prearranged workpiece comprises a carriage mounted for movement along an axis located underneath said first shelf, and wherein said means for automatically attaching a pallet comprises means, affixed to said carriage, for automatically locking a pallet to said carriage in response to a lock signal from said automatic control system.

8. The apparatus of claim 7 wherein said means, affixed to said carriage, for automatically locking a pallet comprises:

means for engaging a first notch located along one side near the first edge of the pallet; and means, rotatably mounted to said carriage, for rotating about an axis so as to engage a second notch located along the opposing side near the first edge of the pallet.

9. The apparatus of claim 8 wherein said means for automatically attaching the pallet comprises:

means, affixed to said carriage, for supporting the received pallet in the vicinity of the first and second notches located along the respective sides of the pallet.

10. The apparatus of claim 9 wherein said means for supporting the received pallet in the vicinity of the first and second notches comprises:

means, affixed to one end of said carriage, for supporting one side of the received pallet in the vicinity of the first notch; and means, mounted to the opposing end of said carriage for releasably supporting the other side of the received pallet in the vicinity of the second notch in response to control signals from said automatic control means.

11. The apparatus of claim 10 wherein said means for releasably supporting the other side of the received pallet in the vicinity of the second notch comprises:

a pallet support rotatably mounted to said carriage; and means, responsive to the automatic control means, for rotating said pallet support into spaced relation relative to said means for supporting one side of the received pallet in the vicinity of the first notch.

12. The apparatus of claim 11 wherein said means for rotating said pallet support comprises:

means, mounted to a stationary base, for moving said pallet support rotatably mounted to said carriage.

13. The apparatus of claim 12 wherein said means, mounted to a stationary base, for moving said pallet support comprises:

means for engaging said pallet support when said carriage is positioned underneath said first shelf, said engaging means having an opening allowing for the insertion and removal of said pallet support.

14. The apparatus of claim 11 wherein said means for rotating said pallet support is operative, in response to a command from said automatic control means, to rotate the pallet support following completion of a sewing pattern in a manner so as to release the support of the pallet in the vicinity of the second notch.

15. The apparatus of claim 14 wherein said means for automatically locking a pallet is operative in response to a release signal from said automatic control means to unlock the pallet from said carriage whereby the released pallet drops onto said means for automatically ejecting the workpiece.

16. The apparatus of claim 14 wherein said means for automatically ejecting the workpiece comprises:

means for monitoring the presence of a pallet;

means, responsive to the detection of the presence of a pallet, for moving the pallet to a remote location so as to allow for the locking of another pallet to said carriage.

17. The apparatus of claim 16 wherein said means for automatically ejecting the workpiece comprises:

means for resetting said means for moving the pallet after a predefined period of time has elapsed following the lifting of the pallet therefrom.

18. The apparatus of claim 16 wherein said automatic control means comprises:

means, responsive to the monitoring of the presence of a pallet on said ejecting means, for delaying the release signal which authorizes the unlocking of a pallet from said carriage.

19. The apparatus of claim 16 wherein said automatic control means comprises:

means for sensing the presence of a pallet resting on said receiving means;

means for monitoring the movement of a pallet resting on said ejecting means; and means, responsive to said sensing of the presence of a pallet on said receiving means and the monitored movement of a pallet resting on said ejecting means, for authorizing a rotation of said first shelf.

20. The apparatus of claim 7 wherein said means for automatically locking a pallet is operative in response to a release signal from said automatic control means to unlock the pallet from said carriage whereby the released pallet drops onto said means for automatically ejecting the workpiece.

21. The apparatus of claim 20 wherein said means for automatically ejecting the workpiece comprises:

means for monitoring the presence of a pallet;

means, responsive to the detection of the presence of a pallet, for moving the pallet to a location so as to allow for the locking of another pallet to said carriage.

22. The apparatus of claim 21 wherein said automatic control means comprises:

means for resetting said means for moving the pallet after a predefined period of time has elapsed following the lifting of the pallet therefrom.

23. The apparatus of claim 21 wherein said automatic control means comprises:

means, responsive to the monitoring of the presence of a pallet on said ejecting means, for delaying the release signal which authorizes the unlocking of a pallet from said carriage.

24. The apparatus of claim 21 wherein said automatic control means comprises:

means for sensing the presence of a pallet resting on said receiving means;

means for monitoring the movement of a pallet resting on said ejecting means; and means, responsive to said sensing of the presence of a pallet on said receiving means and the monitored movement of a pallet resting on said ejecting means, for authorizing a rotation of said first shelf.

25. The apparatus of claim 3 wherein said means for automatically positioning the prearranged workpiece comprises:

a carriage mounted for movement along an axis automatically positioned underneath said first shelf; and means, affixed to said carriage, for supporting the first edge of the received pallet when dropped from said first shelf.

26. The apparatus of claim 25 wherein said means, affixed to said carriage, for supporting the first edge of the received pallet comprises:

means, affixed to one end of said carriage, for supporting one side of the received pallet; and means, mounted to the opposing end of said carriage, for releasably supporting the other side of the received pallet in response to control signals from said automatic control means.

27. The apparatus of claim 26 wherein said means for releasably supporting the other side of the received pallet comprises:

a pallet support rotatably mounted to said carriage; and means, responsive to said automatic control means, for rotating said pallet support into spaced relation relative to said means for supporting one side of the received pallet.

28. The apparatus of claim 27 wherein said means for rotating said pallet support comprises:

means, mounted to a stationary base, for moving said pallet support rotatably mounted to said carriage.

29. The apparatus of claim 28 wherein said means, mounted to a stationary base, for moving said pallet support comprises:

means for engaging said pallet support when said carriage is positioned underneath said first shelf, said engaging means having an opening allowing for the insertion and removal of said pallet support.

30. The apparatus of claim 3 wherein said pair of independently operable shelves further comprises:

a second shelf pivotally mounted to a parallel bar linkage that is in turn pivotally mounted above said automatic positioning means;

first means attached to the parallel bar linkage for rotating said second shaft toward said automatic positioning means to a first location; and second means attached to the parallel bar linkage for withdrawing said second shelf from supporting the second edge of the received pallet so as to drop the received pallet to a location for processing by said automatic positioning means.

31. The apparatus of claim 30 wherein said first means is operative to move said second shelf upwardly in response to a reset signal from said automatic control means and wherein said second means is operative to move said second shelf outwardly in response to another reset signal from said automatic control means.

32. The apparatus of claim 2 wherein said automatic control means comprises:

means for sensing the presence of a pallet resting on said pair of independently operable shelves; and means, responsive to the sensing of the presence of a pallet resting on said pair of independently operable shelves, for controlling the rotational movements of said pair of shelves so as to drop the pallet to a location relative to said automatic positioning means.

33. The apparatus of claim 32 wherein said means for automatically positioning the prearranged workpiece comprises a carriage mounted for movement along an axis located underneath said first shelf, and wherein said means for automatically attaching a pallet comprises means, affixed to said carriage, for automatically locking a pallet to said carriage in response to a lock signal from said automatic control system.

34. The apparatus of claim 33 wherein said means for automatically locking a pallet is operative in response to a release signal from said automatic control means to unlock the pallet from said carriage whereby the released pallet drops onto said means for automatically ejecting the workpiece.

35. The apparatus of claim 34 wherein said means for automatically ejecting the workpiece comprises:

means for monitoring the presence of a pallet; and means, responsive to the detection of the presence of a pallet, for moving the pallet to a location so as to allow for the locking of another pallet to said carriage.

36. The apparatus of claim 35 wherein said automatic control means comprises:

means for resetting said means for moving the pallet after a predefined period of time has elapsed following the lifting of the pallet therefrom.

37. The apparatus of claim 36 wherein said automatic control means comprises:

means, responsive to the monitoring of the presence of a pallet on said ejecting means, for delaying the release signal which authorizes the unlocking of a pallet from said carriage.

38. The apparatus of claim 32 wherein said automatic control means comprises:

means, responsive to the detection of the lack of a pallet being present on said pair of independently operable shelves, for awaiting a start authorization.

39. The apparatus of claim 2 wherein said automatic control means comprises:

means for monitoring the movement of said ejecting means when a pallet is being moved away from said carriage; and means, responsive to the monitored movement of said ejecting means, for authorizing the controlled dropping of another pallet resting on said pair of independently operable shelves.

40. The apparatus of claim 2 wherein said means for automatically positioning the prearranged workpiece comprises:

a carriage mounted for movement along an axis automatically positioned under said pair of independently operable shelves; and means, affixed to said carriage for supporting a received pallet when dropped from said pair of independently operable shelves.

41. The apparatus of claim 40 wherein said means, affixed to said carriage, for supporting the received pallet comprises:

means, affixed to one end of said carriage, for supporting one side of the received pallet; and means, mounted to the opposing end of said carriage, for releasably supporting the other side of the received pallet in response to control signals from said automatic control means.

42. The apparatus of claim 1 wherein said means for automatically positioning the prearranged workpiece comprises a carriage mounted for movement along an axis located under said receiving means, and wherein said means for automatically attaching a pallet comprises means, affixed to said carriage, for automatically locking a pallet to said carriage in response to a lock signal from said automatic control system.

43. The apparatus of claim 42 wherein said means, affixed to said carriage, for automatically locking a pallet comprises:

means for engaging a first notch located along one side near the first edge of the pallet; and means, mounted to said carriage, for rotating about an axis so as to engage a second notch located along the opposing side near the first edge of the pallet.

44. The apparatus of claim 43 wherein said means for automatically positioning the prearranged workpiece comprises:

means, affixed to said carriage, for supporting the received pallet in the vicinity of the first and second notches located along the respective sides of the pallet.

45. The apparatus of claim 44 wherein said means for supporting the received pallet in the vicinity of the first and second notches comprises:

means, affixed to one end of said carriage, for supporting one side of the received pallet in the vicinity of the first notch; and means, mounted to the opposing end of said carriage for releasably supporting the other side of the received pallet in the vicinity of the second notch in response to control signals from said automatic control means.

46. The apparatus of claim 45 wherein said means for releasably supporting the other side of the received pallet in the vicinity of the second notch comprises:

a pallet support rotatably mounted to said carriage; and means, responsive to the automatic control means, for rotating said pallet support into spaced relation relative to said means for supporting one side of the received pallet in the vicinity of the second notch.

47. The apparatus of claim 46 wherein said means for rotating said pallet support comprises:

means, mounted to a stationary base, for moving said pallet support rotatably mounted to said carriage.

48. The apparatus of claim 47 wherein said means, mounted to a stationary base, for moving said pallet support comprises:

means for engaging said pallet support when said carriage is positioned underneath said first shelf, said engaging means having an opening allowing for the insertion and removal of said pallet support.

49. The apparatus of claim 46 wherein said means for rotating said pallet support is operative, in response to a command from said automatic control means to rotate the pallet support following completion of a sewing pattern in a manner so as to release the support of the pallet in the vicinity of the second notch.

50. The apparatus of claim 49 wherein said means for automatically locking a pallet is operative in response to a release signal from said automatic control means to unlock the pallet from said carriage whereby the released pallet drops onto said means for automatically ejecting the workpiece.

51. The apparatus of claim 46 wherein said means for automatically ejecting the workpiece comprises:
means for monitoring the presence of a pallet; and
means, responsive to the detection of the presence of a pallet, for moving the pallet to a location so as to allow for the locking of another pallet to said carriage.

52. The apparatus of claim 51 wherein said means for automatically ejecting the workpiece comprises:
means for resetting said means for moving the pallet after a predefined period of time has elapsed following the lifting of the pallet therefrom.

53. The apparatus of claim 51 wherein said automatic control means comprises:
means, responsive to the monitoring of the presence of a pallet on said ejecting means, for delaying the release signal which authorizes the unloading of a pallet from said carriage.

54. The apparatus of claim 1 wherein said automatic control means comprises:
means for sensing the presence of a pallet resting on said receiving means; and
means, responsive to the sensing of the presence of a pallet resting on said receiving means, for dropping the prearranged workpiece within a pallet to said means for automatically attaching the pallet to said positioning means.

55. The apparatus of claim 54 wherein said means for automatically positioning the prearranged workpiece comprises a carriage mounted for movement along an axis located underneath said receiving means; and wherein said means for automatically attaching a pallet comprises means affixed to said carriage for supporting the pallet when dropped from said receiving means.

56. The apparatus of claim 55 wherein said means, affixed to said carriage, for supporting the pallet when dropped from said receiving means comprises:
means, affixed to one end of said carriage, for supporting one side of the received pallet; and
means, mounted to the opposing end of said carriage, for releasably supporting the other side of the received pallet in response to control signals from said automatic control means.

57. The apparatus of claim 56 wherein said means for releasably supporting the other side of the received pallet comprises:
a pallet support rotatably mounted to said carriage; and
means, responsive to the automatic control means, for rotating said pallet support into spaced relation relative to said means for supporting one side of the received pallet.

58. The apparatus of claim 57 wherein said means for rotating said pallet support comprises:
means, mounted to a stationary base, for moving said pallet support rotatably mounted to said carriage.

59. The apparatus of claim 58 wherein said means, mounted to a stationary base, for moving said pallet support comprises:
means for engaging said pallet support when said carriage is positioned underneath said first shelf, said engaging means having an opening allowing for the insertion and removal of said pallet support.

60. A system for automatically processing pallets containing workpieces that are to be sewn, said system comprising:
means for positioning a pallet containing a workpiece relative to a reciprocating needle within a sewing machine;
means for receiving a pallet containing a workpiece at a location above said positioning means;
means for dropping the received pallet containing a workpiece to a location relative to said positioning means whereby the pallet can be thereafter attached to said positioning means; and
means for attaching the dropped pallet to said positioning means.

61. The system of claim 60 further comprising:
means, affixed to said positioning means, for supporting the dropped pallet from said receiving means prior to the attachment of the pallet to said positioning means.

62. The system of claim 61 further comprising:
means for releasing said supporting means following the sewing of the workpiece.

63. The system of claim 62 further comprising:
means for detaching the pallet from the positioning means following the sewing of the workpiece.

64. The system of claim 63 further comprising:
means for engaging and moving the detached pallet to a remote location which allows another pallet to be attached to said positioning means.

65. The system of claim 64 further comprising:
means for monitoring the presence of a pallet on said engaging and moving means; and
means, responsive to said monitoring means, for resetting said engaging and moving means after a predefined period of time has elapsed following removal of the pallet from said engaging and moving means.

66. The system of claim 64 further comprising:
means for monitoring the movement of said means for engaging and moving the detached pallet to a remote location; and
means, responsive to the monitored movement of said engaging and moving means, for authorizing the dropping of a pallet containing a workpiece in the receiving means only after movement of the engaging and moving means has occurred.

67. The system of claim 60 wherein said means for receiving a pallet containing a workpiece comprises:
a pair of independently operable shelves spaced apart so as to receive and suspend a pallet in a position above said automatic positioning means.

68. The apparatus of claim 67 wherein said pair of independently operable shelves comprises:
a first shelf for supporting a first edge of a received pallet, said first shelf being rotatable about a first axis; and
a second shelf for supporting a second edge of a received pallet.

69. The system of claim 68 wherein said means for dropping the received pallet containing a workpiece comprises:
means for rotating said first shelf about said first axis so as to drop the first edge of the received pallet; and
means for moving said second shelf downwardly, so as to lower the second edge of the received pallet following the dropping of the first edge of the received pallet.

70. The apparatus of claim 69 wherein said means for positioning the pallet containing a workpiece comprises:

a carriage mounted for movement along an axis positioned underneath said first shelf; and means, affixed to said carriage, for supporting the first edge of the received pallet when dropped from said first shelf.

71. The apparatus of claim 70 wherein said means, affixed to said carriage, for supporting the first edge of the received pallet comprises:

means, affixed to one end of said carriage, for supporting one side of the received pallet; and means, rotatably mounted to the opposing end of said carriage, for releasably supporting the other side of the received pallet.

72. The apparatus of claim 71 wherein said means for releasably supporting the other side of the received pallet comprises:

a pallet support rotatably mounted to said carriage; and means for rotating said pallet support into spaced relation relative to said means for supporting one side of the received pallet.

73. The apparatus of claim 72 wherein said means for rotating said pallet support comprises:

means, mounted to a stationary base, for moving said pallet support rotatably mounted to said carriage.

74. The apparatus of claim 73 wherein said means, mounted to a stationary base, for moving said pallet support comprises:

means for engaging said pallet support when said carriage is positioned underneath said first shelf, said engaging means having an opening allowing for the insertion and removal of said pallet support.

75. The system of claim 67 wherein said means for dropping the received pallet containing a workpiece comprises:

means for sensing the presence of a pallet resting on said pair of independently operable shelves; and means, responsive to the sensing of the presence of a pallet resting on said pair of independently operable shelves, for controlling the rotational movements of said pair of shelves so as to drop the pallet to a location relation to said positioning means.

76. The system of claim 75 wherein said means for attaching a pallet to said positioning means comprises:

means, affixed to said positioning means, for engaging a first notch located along one side near a first edge of the pallet; and means, affixed to said positioning means, for rotating about an axis so as to engage a second notch located along the opposing side near the first edge of the pallet.

77. The system of claim 76 further comprising:

means, affixed to said positioning means, for supporting the received pallet in the vicinity of the first notch; and means, mounted to said positioning means, for releasably supporting the received pallet in the vicinity of the second notch.

78. The apparatus of claim 67 wherein said pair of independently operable shelves comprises:

a first shelf for supporting a first edge of a received pallet, said first shelf being rotatable about a first axis; and a second shelf pivotally mounted to a parallel bar linkage that is in turn pivotally mounted above said automatic positioning means.

79. The apparatus of claim 78 wherein said means for dropping the received pallet containing a workpiece comprises:

means for rotating said first shelf about said first axis so as to drop the first edge of the received pallet;

first means attached to the parallel bar linkage for rotating said second shelf downwardly toward said positioning means; and second means attached to said parallel bar linkage for withdrawing said second shelf from supporting the second edge of the received pallet so as to drop the pallet to the location relative to said positioning means whereby the workpiece can be thereafter attached to said positioning means.

80. The system of claim 60 further comprising:

means for detecting the presence of a pallet within said receiving means; and means, responsive to the detection of a pallet being present, for authorizing the dropping of the pallet by said means for dropping the workpiece to said positioning means.

81. In an automatic sewing machine system, apparatus for automatically processing a plurality of workpieces prearranged within pallets, said apparatus comprising:

means for automatically positioning a prearranged workpiece within a pallet relative to a sewing needle so as to produce a sewn workpiece;

means for releasing the pallet from the positioning means following the sewing of the workpiece; and means for engaging and moving the released pallet to a remote location which allows another pallet to be attached to said positioning means.

82. The system of claim 81 further comprising:

means for monitoring the presence of a pallet on said engaging and moving means; and means, responsive to said monitoring means, for resetting said engaging and moving means after a predefined period of time has elapsed following removal of the pallet from said engaging and moving means.

83. The apparatus of claim 81 further comprising:

means for monitoring the presence of a pallet on said engaging and moving means; and means, responsive to the presence of a pallet on said engaging and moving means for delaying the release of another pallet associated with said positioning means.

84. The apparatus of claim 81 wherein said means for engaging and moving the released pallet to a remote location comprises:

means, located below said positioning means, for extending upwardly into engagement with predefined holes in a released pallet so as to support the pallet; and means for moving the thus engaged pallet downwardly to a remote location which does not interfere with said positioning means.

85. In an automatic sewing machine system, apparatus for processing a plurality of workpieces prearranged within pallets, said apparatus comprising:

means for receiving a prearranged workpiece within a pallet;

means for sensing the presence of a pallet resting on said receiving means; and means, responsive to the sensing of the presence of a pallet resting on said receiving means, for dropping the pallet to a means for automatically positioning the workpiece relative to a sewing needle whereby said workpiece is positioned so as to produce a sewn workpiece.

86. The apparatus of claim 85 further comprising:

means for releasing the pallet from said automatic positioning means following the sewing of the workpiece.

87. The apparatus of claim 86 further comprising:

means for engaging and moving the released pallet to a remote location so as to allow another pallet to be dropped from said receiving means.

* * * * *